US010822836B2

(12) United States Patent
Nakasone

(10) Patent No.: US 10,822,836 B2
(45) Date of Patent: Nov. 3, 2020

(54) ELECTRIC LOCK DEVICE FOR OPENING AND CLOSING BODY

(71) Applicant: PIOLAX, INC., Yokohama-shi (JP)

(72) Inventor: Hisashi Nakasone, Yokohama (JP)

(73) Assignee: PIOLAX, INC., Yokohama-Shi, Kanagawa (JP)

( * ) Notice: Subject to any disclaimer, the term of this patent is extended or adjusted under 35 U.S.C. 154(b) by 402 days.

(21) Appl. No.: 15/574,104

(22) PCT Filed: May 11, 2016

(86) PCT No.: PCT/JP2016/064026
§ 371 (c)(1),
(2) Date: Nov. 14, 2017

(87) PCT Pub. No.: WO2016/185973
PCT Pub. Date: Nov. 24, 2016

(65) Prior Publication Data

US 2018/0371795 A1 Dec. 27, 2018

(30) Foreign Application Priority Data

May 19, 2015 (JP) ..... 2015-101804

(51) Int. Cl.
*E05B 47/00* (2006.01)
*E05B 83/30* (2014.01)
(Continued)

(52) U.S. Cl.
CPC ..... *E05B 47/0012* (2013.01); *E05B 63/0052* (2013.01); *E05B 83/30* (2013.01);
(Continued)

(58) Field of Classification Search
CPC .. E05B 47/0012; E05B 63/0052; E05B 83/30; E05B 63/18; E05B 2047/002;
(Continued)

(56) References Cited

U.S. PATENT DOCUMENTS 7,455,333 B2 * 11/2008 Ookawara ..... E05B 83/30 292/34
8,876,172 B2 * 11/2014 Denison ..... E05B 47/0012 292/144
(Continued)

FOREIGN PATENT DOCUMENTS

CN 104011308 A 8/2014
CN 104118361 A 10/2014
(Continued)

OTHER PUBLICATIONS

International Search Report (ISR) (PCT Form PCT/ISA/210), in PCT/JP2016/064026, dated Aug. 9, 2016, and English translation thereof.
(Continued)

*Primary Examiner* — Kristina R Fulton
*Assistant Examiner* — Thomas L Neubauer
(74) *Attorney, Agent, or Firm* — McGinn I.P. Law Group, PLLC

(57) ABSTRACT

An electric locking device for an operable/closable member attached to an opening portion, includes a biasing member which biases a pair of rods in a direction in which the rods are brought into engagement with a pair of locking portions, an actuator for sliding the rods to disengage from the locking portions, the actuator having a case having an opening portion, a motor disposed within the case, a worm rotated by the motor and a worm wheel supported rotatably on the case and interlocked with the worm for rotation. The worm wheel has a rotating portion projecting outwards of the case from the opening portion, and proximal end portions of the rods are assembled individually to the rotating portion so as to move in an associated fashion, causing the rods to slide in a synchronized fashion in opposite directions to each other.

12 Claims, 19 Drawing Sheets

(51) Int. Cl.

| | |
|---|---|
| ***E05C 9/04*** | (2006.01) |
| ***E05B 63/00*** | (2006.01) |
| *E05B 63/18* | (2006.01) |
| *E05C 21/00* | (2006.01) |

(52) U.S. Cl.
CPC ..... *E05C 9/041* (2013.01); *E05C 9/043* (2013.01); *E05C 9/048* (2013.01); *E05B 63/18* (2013.01); *E05B 2047/002* (2013.01); *E05B 2047/0022* (2013.01); *E05C 21/00* (2013.01)

(58) Field of Classification Search
CPC .. E05B 2047/0022; E05C 9/041; E05C 9/048; E05C 9/043; E05C 21/00; E05C 9/04
See application file for complete search history.

(56) References Cited

U.S. PATENT DOCUMENTS

| | | | | |
|---|---|---|---|---|
| 10,011,170 | B2 * | 7/2018 | Horikawa | E05B 81/40 |
| 2007/0080542 | A1 | 4/2007 | Ookawara | |
| 2010/0071424 | A1 * | 3/2010 | Tsuruta | E05B 63/248 70/91 |
| 2011/0309640 | A1 | 12/2011 | Matsubara | |
| 2015/0137527 | A1 | 5/2015 | Hattori | |
| 2015/0152671 | A1 | 6/2015 | Nakasone | |

FOREIGN PATENT DOCUMENTS

| | | | |
|---|---|---|---|
| CN | 104285079 | A | 1/2015 |
| CN | 104379860 | A | 2/2015 |
| JP | H 08-2358 | Y2 | 1/1996 |
| JP | 3316349 | B2 | 8/2002 |
| JP | 2007-100343 | A | 4/2007 |
| JP | 2013-234742 | A | 11/2013 |
| JP | 5629131 | B2 | 11/2014 |

OTHER PUBLICATIONS (PCT Form PCT/ISA/237), in PCT/JP2016/064026, dated Aug. 9, 2016.
Chinese Office Action, dated Jan. 16, 2019, in Chinese Application No. 201680028823.2 and English Translation thereof.

* cited by examiner

ELECTRIC LOCK DEVICE FOR OPENING AND CLOSING BODY

TECHNICAL FIELD

The present invention relates to an electric locking device for an openable/closable member for locking an openable/closable member which is attached to an opening portion of a fixed member so as to be opened and closed in a closed state.

BACKGROUND ART

For example, an openable/closable member such as a lid is attached to an opening portion formed in a fixed member such as a glove box of a motor vehicle so as to be opened and closed. Then, a locking device is provided between the opening portion and the openable/closable member not only to lock the openable/closable member when the openable/closable member is closed but also to unlock the openable/closable member when the openable/closable member is opened. Additionally, there is known a locking device which is configured to unlock an openable/closable member using an electric actuator.

Patent Document 1 below describes a locking device utilizing an actuator. This actuator is made up of a motor, a worm fixed to a rotational shaft of the motor, a worm wheel configured to mesh with the worm, a pinion provided on one surface of the worm wheel so as to project therefrom and a drive member configured to slide on the pinion via a rack. Additionally, a pair of locking members are disposed above a box member of a glove box so as to slide via a link, and locking claw portions at tip ends of the locking members are biased towards fitting holes in a lid member of the glove box by a torsion coil spring. Further, one of the locking members is pressed on against a biasing force of the torsion coil spring by the driving member of the actuator to draw in the locking claw portion from the fitting hole.

Then, when the motor of the actuator is activated to operate in such a state that the locking claw portions of the pair of locking members fit in the fitting holes to close the lid member, the worm rotates the worm wheel, and the driving member slides via the pinion to press on the one of the locking members, whereby not only is the locking claw portion of the one of the locking members drawn in from the fitting hole, but also the locking claw portion of the other locking member is drawn in from the fitting hole, so that the lid member is opened.

PRIOR ART DOCUMENT

Patent Document

Patent Document 1: JP-A-2013-234742

SUMMARY OF INVENTION

Problems to be Solved by Invention

In the locking device of Patent Document 1 described above, however, the link is necessary for the pair of locking members in addition to the actuator and the pair of locking members, and this increases the number of parts involved, resulting in the complex construction.

Thus, an object of the invention is to provide an electric locking device for an openable/closable member which can simplify the construction thereof by reducing the number of parts involved.

Means for Solving Problems

In order to achieve the above object, according to the invention, there is provided an electric locking device for an openable/closable member attached to an opening portion in a fixed member so as to be opened and closed, including a pair of locking portions provided on one of the openable/closable member and the opening portion in the fixed member, a pair of rods disposed on the other of the openable/closable member or the fixed member and configured to engage with and disengage from the locking portions, a biasing means for biasing the pair of rods in a direction in which the pair of rods are brought into engagement with the locking portions, and an actuator for sliding the pair of rods to disengage from the pair of locking portions, wherein the actuator has a case having an opening portion, a motor disposed within the case, a worm rotated by the motor, and a worm wheel supported rotatably on the case and interlocked with the worm for rotation, and wherein the worm wheel has a rotating portion projecting outwards of the case from the opening portion of the case, and proximal end portions of the pair of rods are assembled individually to the rotating portion so as to move in an associated fashion, causing the pair of rods to slide in a synchronized fashion in opposite directions to each other.

In the electric locking device for an openable/closable member according to the invention, it is preferable that the proximal end portions of the pair of rods are supported individually and pivotally on the rotating portion of the worm wheel.

In the electric locking device for an openable/closable member according to the invention, it is preferable that a pinion gear is formed concentrically on the rotating portion of the worm wheel, that a rack configured to mesh with the pinion gear is formed on the proximal end portions of the pair of rods, and that the proximal end portions of the pair of rods are assembled individually to the rotating portion of the worm wheel so as to move in an associated fashion.

In the electric locking device for an openable/closable member according to the invention, it is preferable that a seal ring is interposed between a rear circumferential edge of the opening portion in the case and a portion of the worm wheel which faces the rear circumferential edge of the opening portion.

In the electric locking device for an openable/closable member according to the invention, it is preferable that when the pair of rods are caused to slide in a disengaging direction from the pair of locking portions by rotating the worm wheel via the worm, the worm wheel is pressed against the seal ring due to a pressing force imparted to teeth of the worm wheel from the worm.

In the electric locking device for an openable/closable member according to the invention, it is preferable that the electric locking device has a holding means for holding the rods in such a state that the rods are not brought into engagement with the locking portions against a biasing force of the biasing means when the pair of rods are caused to slide in a disengaging direction from the pair of locking portions as a result of rotation of the worm wheel and releasing the holding of the rods to cause the rods to slide in an engaging direction with the locking portions when the openable/closable member is closed relative to the opening portion in the fixed member.

In the electric locking device for an openable/closable member according to the invention, it is preferable that the electric locking device further includes a connector case for insertion of a power supply connector, that the motor is connected to a bus bar which is incorporated in the connector case to electrically communicate with the power supply connector inserted into the connector case, and that the connector case is disposed on the same side as the worm wheel with respect to an axis of the worm and in parallel to an axial direction of the worm.

In the electric locking device for an openable/closable member according to the invention, it is preferable that a connector case of the actuator is a separate member from the case and is attached detachably to the case.

Advantageous Effects of Invention

According to the invention, since the pair of rods biased by the biasing means are brought into engagement with the pair of locking portions by closing the openable/closable member relative to the opening portion in the fixed member, the openable/closable member can be locked in such a state that the opening portion in the fixed member is closed by the openable/closable member. In this state, when the motor of the actuator is rotated to rotate the worm wheel in association with the worm, disengaging the pair of rods from the pair of locking portions, the openable/closable member can be unlocked to open the opening portion in the fixed member.

Then, in this electric locking device, the worm wheel has the rotating portion which projects outwards of the case from the opening portion in the case, and the proximal end portions of the pair of rods are assembled individually to the rotating portion so as to move in an associated fashion, whereby the pair of rods are made to move in association with rotation of the worm wheel. Thus, the construction of the electric locking device can be simplified by reducing the number of parts involved.

BRIEF DESCRIPTION OF DRAWINGS

FIGS. 1A and 1B show an embodiment of an electric locking device for an openable/closable member according to the invention, in which FIG. 1A is a perspective view showing a state in which the openable/closable member is closed, and FIG. 1B is a perspective view showing a state in which the openable/closable member is opened.

FIGS. 15A and 15B show another embodiment of an electric locking device for an openable/closable member according to the invention, in which FIG. 15A is a perspective view showing a state in which the openable/closable member is closed, and FIG. 15B is a perspective view showing a state in which the openable/closable member is opened.

EMBODIMENTS OF INVENTION

Figure 1A:
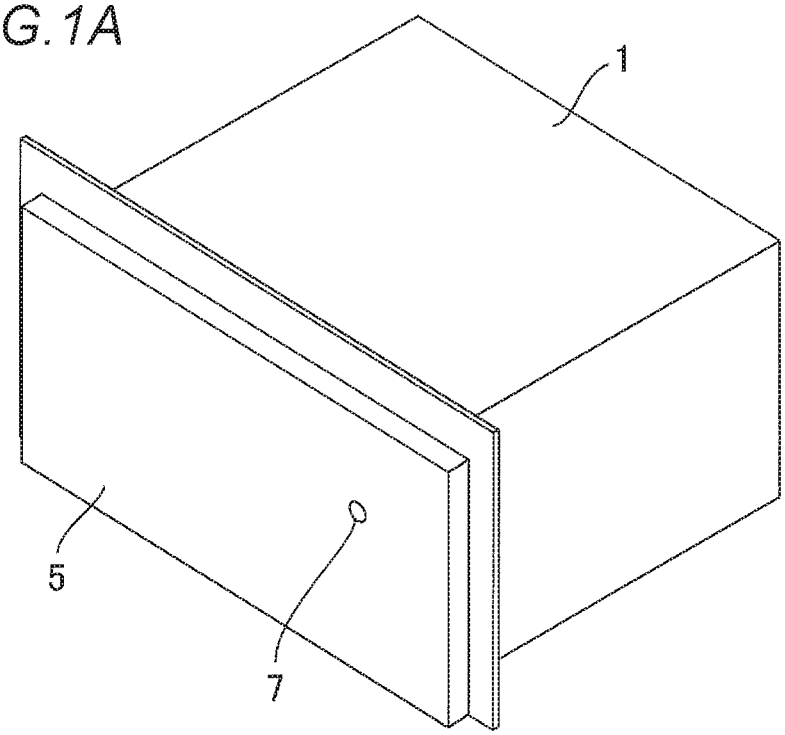

Hereinafter, referring to the drawings, an embodiment of an electric locking device for an openable/closable member according to the invention will be described.

Figure 1B:
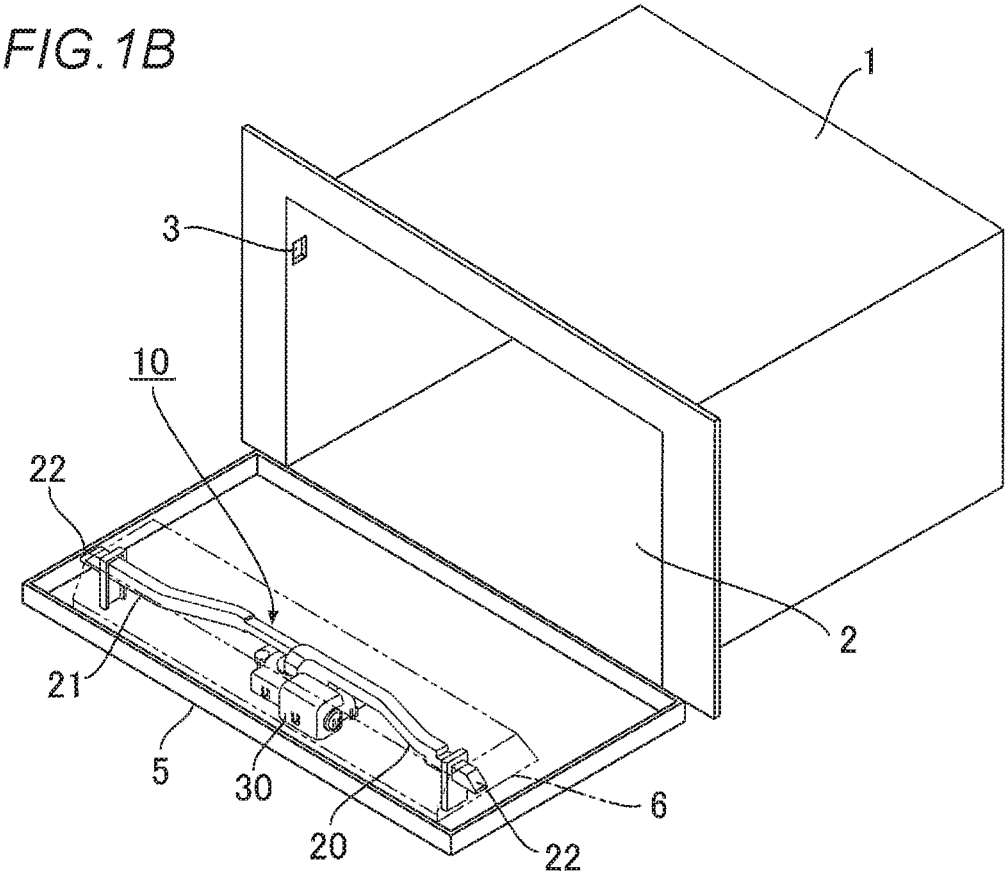

As shown in FIGS. 1A and 1B, an electric locking device 10 for an openable/closable member according to this embodiment (hereinafter, referred to as an "electric locking device 10") is used to electrically lock and unlock an openable/closable member 5 which is attached to an opening portion 2 in a fixed member 1 such as a glove box or the like provided in an instrument panel of a vehicle so as to be opened and closed.

It should be noted that this locking device may be applied, for example, to a structure in which a box-shaped glove box is attached rotatably to an opening portion in an instrument panel (in this case, the instrument panel constitutes a "fixed member," and the glove box constitutes an "openable/closable member) or a structure in which a lid is attached to an opening portion in an instrument panel (in this case, the instrument panel constitutes a "fixed member," and the lid constitutes an "openable/closable member), and the locking device can be used widely for a variety of openable/closable members which open and close an opening portion in a fixed member.

Figure 10:
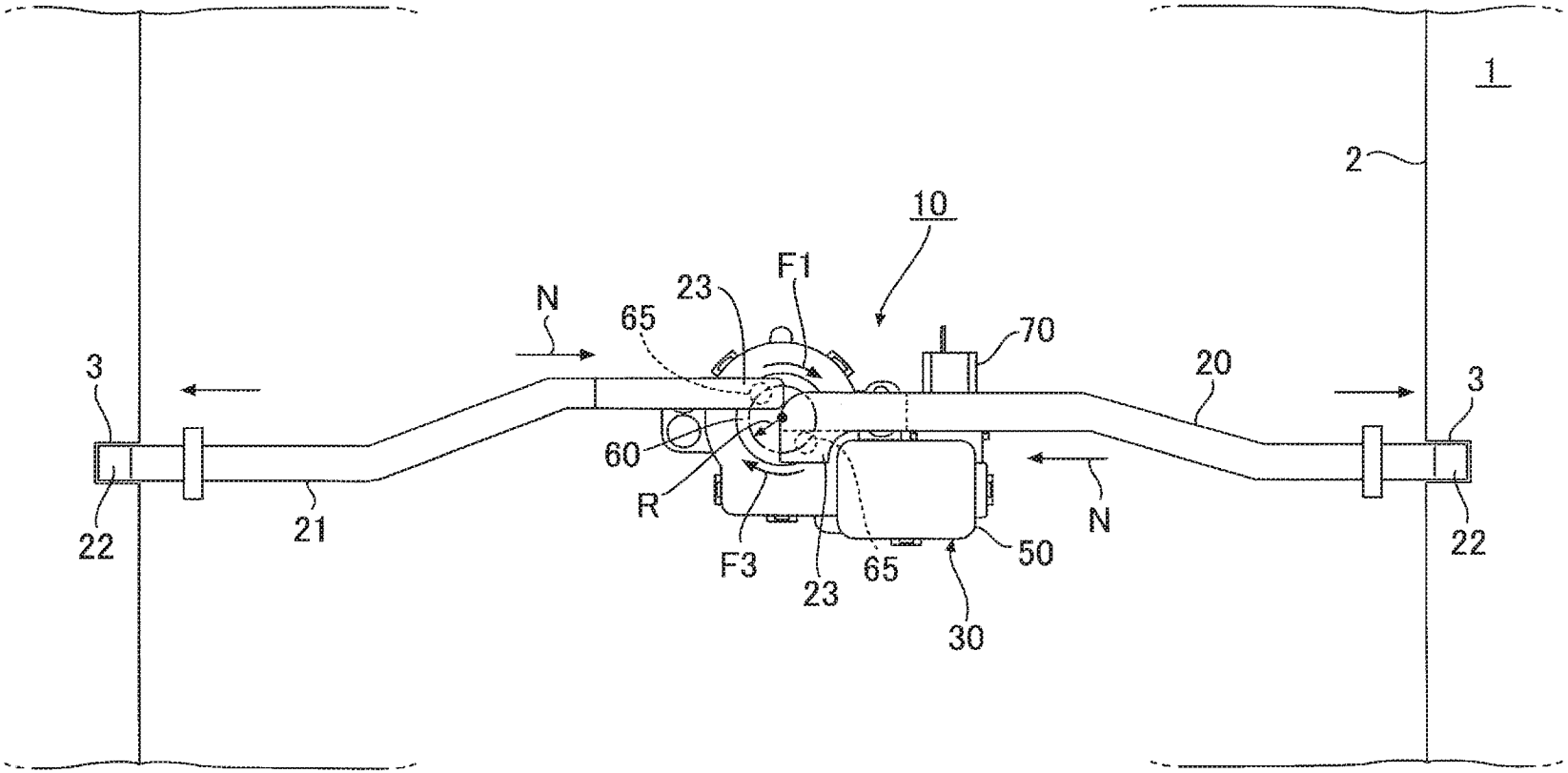
FIG. 10 is an explanatory view showing a state in which an openable/closable member is closed by the electric locking device.

As shown in FIGS. 1 and 10, in this embodiment, a pair of locking portions 3, 3 are provided on inner surfaces of both sides of an opening portion 2 in a fixed member 1. It should be noted that the locking portions 3 may be provided on a side of an openable/closable member 5 (this will be described in another embodiment). There is no specific limitation on the shape of the locking portions 3, and hence, the locking portions 3 do not always have to be formed into a circular shape but may be formed into any shape with which rods 20, 21, which will be described later, can be brought into engagement, and for example, a recess portion, a projection, a frame shape and the like may be adopted.

Figure 5:
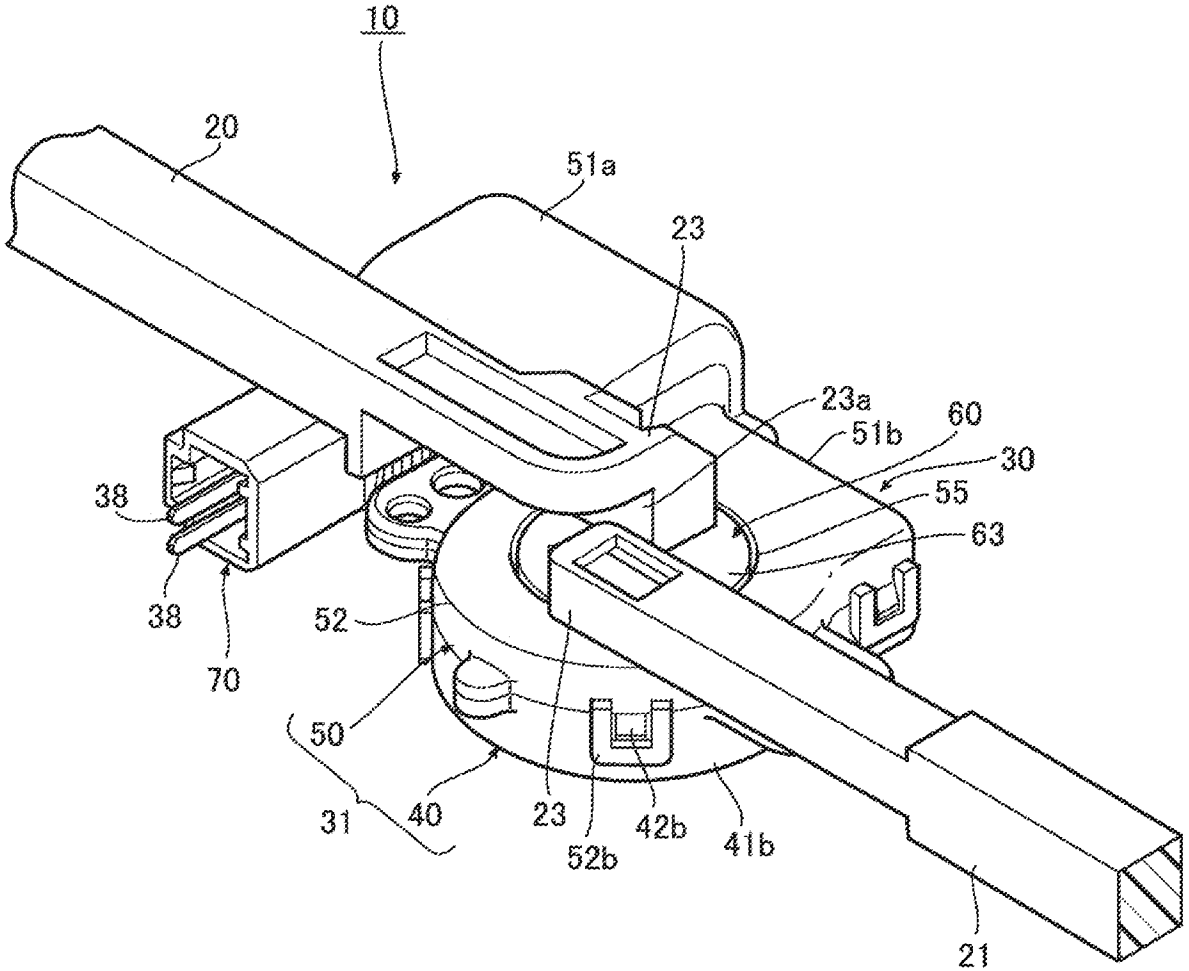
FIG. 5 is a perspective view of the actuator with a pair of rods pivotally supported thereon.

On the other hand, as shown in FIG. 1(*b*), a horizontally and longitudinally elongated box 6 is provided on an inner surface side of the openable/closable member 5 (a side of the opening portion 2 in the fixed member 1), and a pair of rods 20, 21 are provided slidably. Additionally, as shown in FIG. 1(*b*), the rods 20, 21 each have a rod shape having a bent portion in a halfway position in an axial direction. An engaging portion 22 having a tapered surface formed thereon is provided at an axial distal end portion of each rod, and the engaging portions 22, 22 are designed to engage with and disengage from the pair of locking portions 3, 3. As shown in FIG. 5, a cut-out 23*a* is formed at a proximal end portion 23 of the rod 20 to prevent an interference with the rod 21. It should be noted that the engaging portions 22 do not always have to be provided at the distal end portions of the rods 20 21 but may be provided halfway in the axial direction. Additionally, the pair of rods may be provided on the fixed member's side (this will be described in another embodiment).

Further, as shown in FIG. 1(*a*), a switch 7 (a switch in the form of a touch switch, a push button switch, a lever switch or the like) for activating a motor 33 of an actuator 30, which will be described later, is disposed in a predetermined position on a front surface side of the openable/closable member 5.

As shown in FIG. 10, the pair of rods 20, 21 are designed to be biased in a direction in which the engaging portions 22 at the distal end sides thereof are brought into engagement with the locking portions 3 by a torsion coil spring 15 (refer to FIGS. 6, 8), which constitutes a "biasing means" in the invention.

Then, the electric locking device 10 of this embodiment has the actuator 30 which disengage the pair of rods 20, 21 from the pair of locking portions 3, 3.

Figure 2:
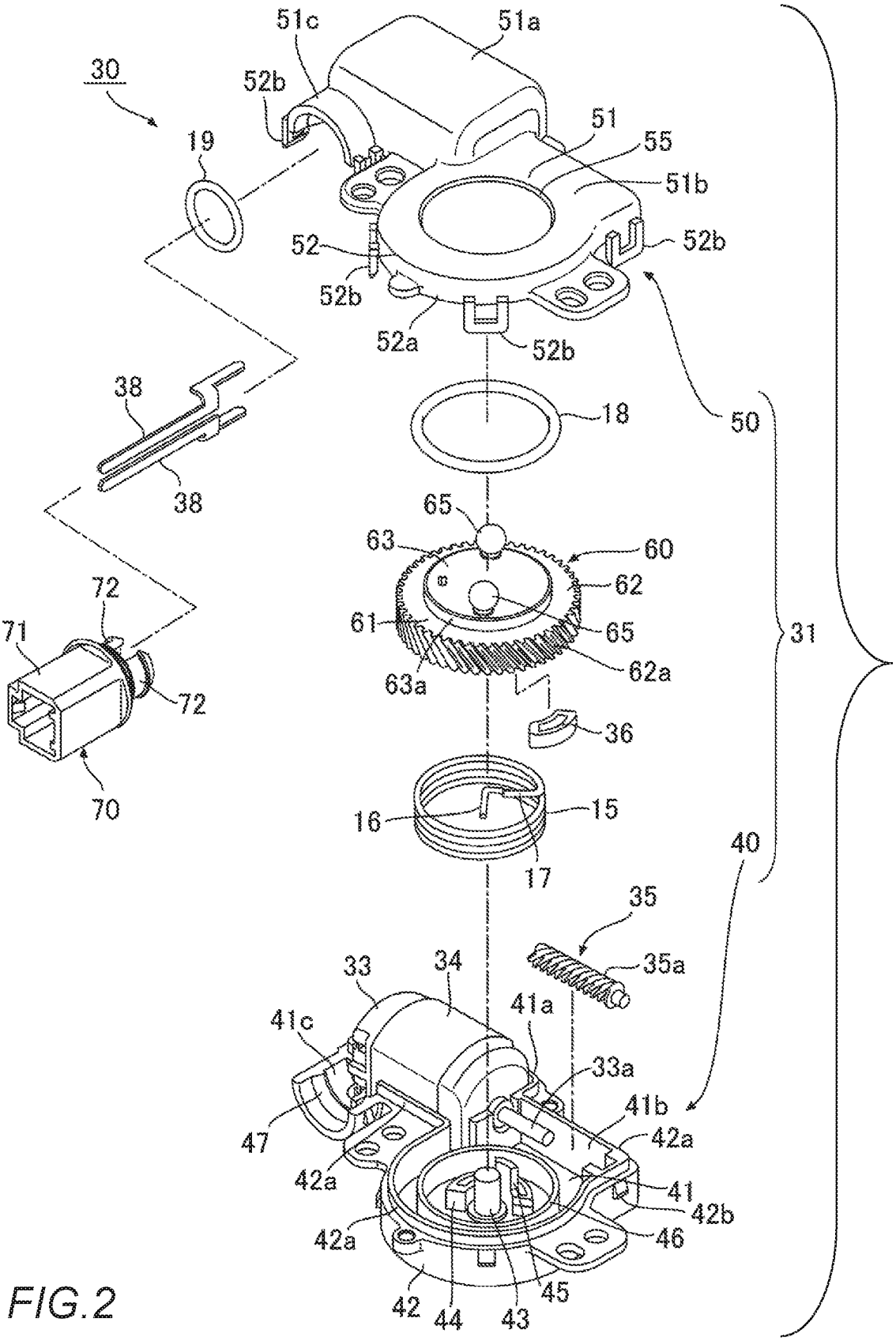
FIG. 2 is an exploded perspective view of the electric locking device according.

As shown in FIG. 2, the actuator 30 of this embodiment has a case 31 having an opening portion 55, the motor 33 which is disposed inside the case 31, a worm 35 which is fixed to a rotational shaft 33*a* of the motor 33, and a worm wheel 60 supported rotatably on the case 31 and configured to rotate in association with the worm 35.

Figure 6:
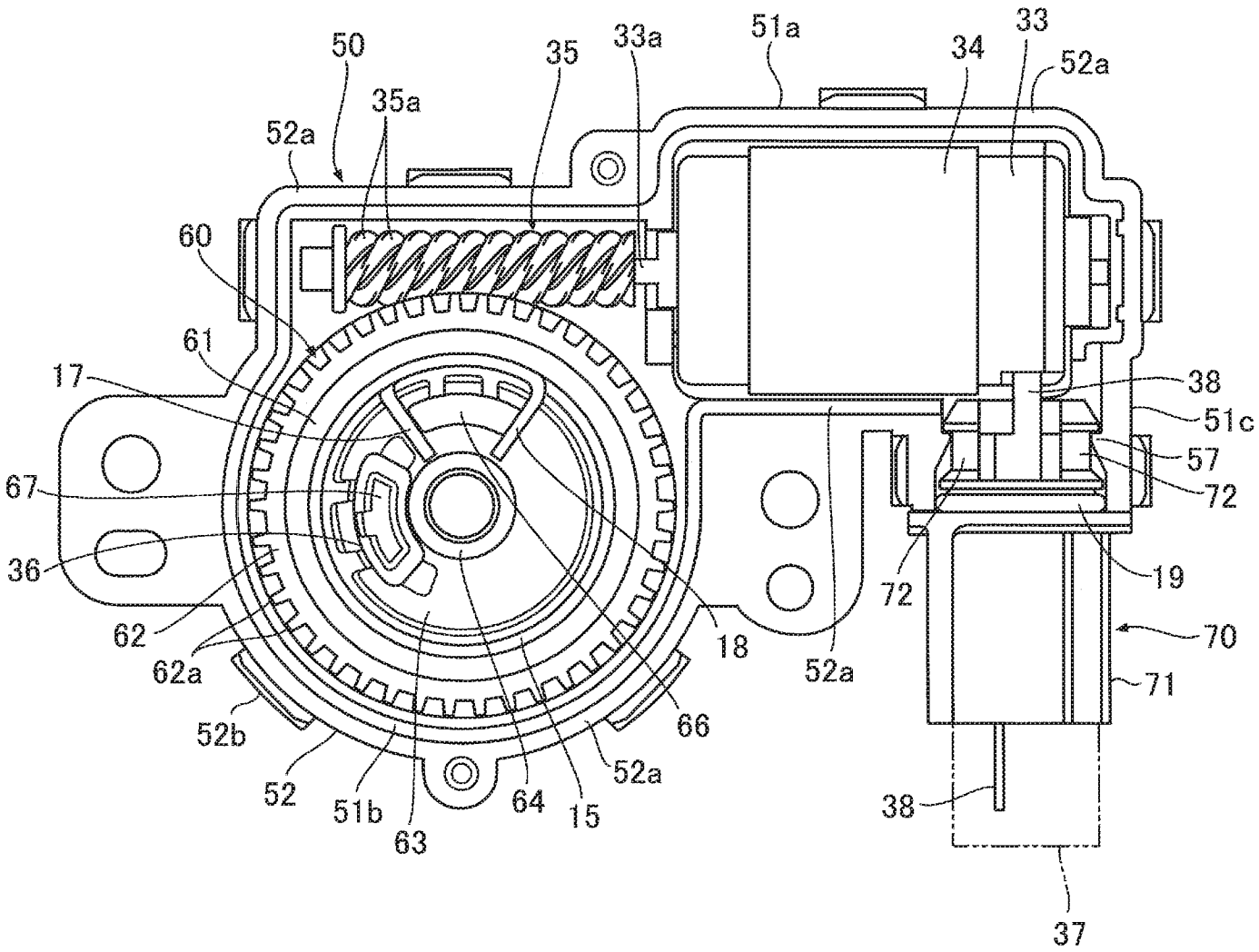
FIG. 6 is a plan view of the actuator with a first case removed.

An anti-vibration cover 34 formed of an elastic material such as rubber is mounted on an outer circumference of the motor 33. Additionally, as shown in FIGS. 6 and 7, the motor 33 is connected to a power supply connector 37 by way of a bus bar 38, and a rotational shaft 33*a* of the motor 33 is designed to rotate by operating the switch 7.

In this embodiment, the case 31 is made up of a first case 40 and a second case 50 which is mounted on the first case 40.

As shown in FIG. 2, the first case 40 is made up of a bottom wall 41 and a circumferential wall 42 which is provided on a circumferential edge of the bottom wall 41 so as to be erected therefrom and is formed into the shape of a bottom frame.

Figure 7:
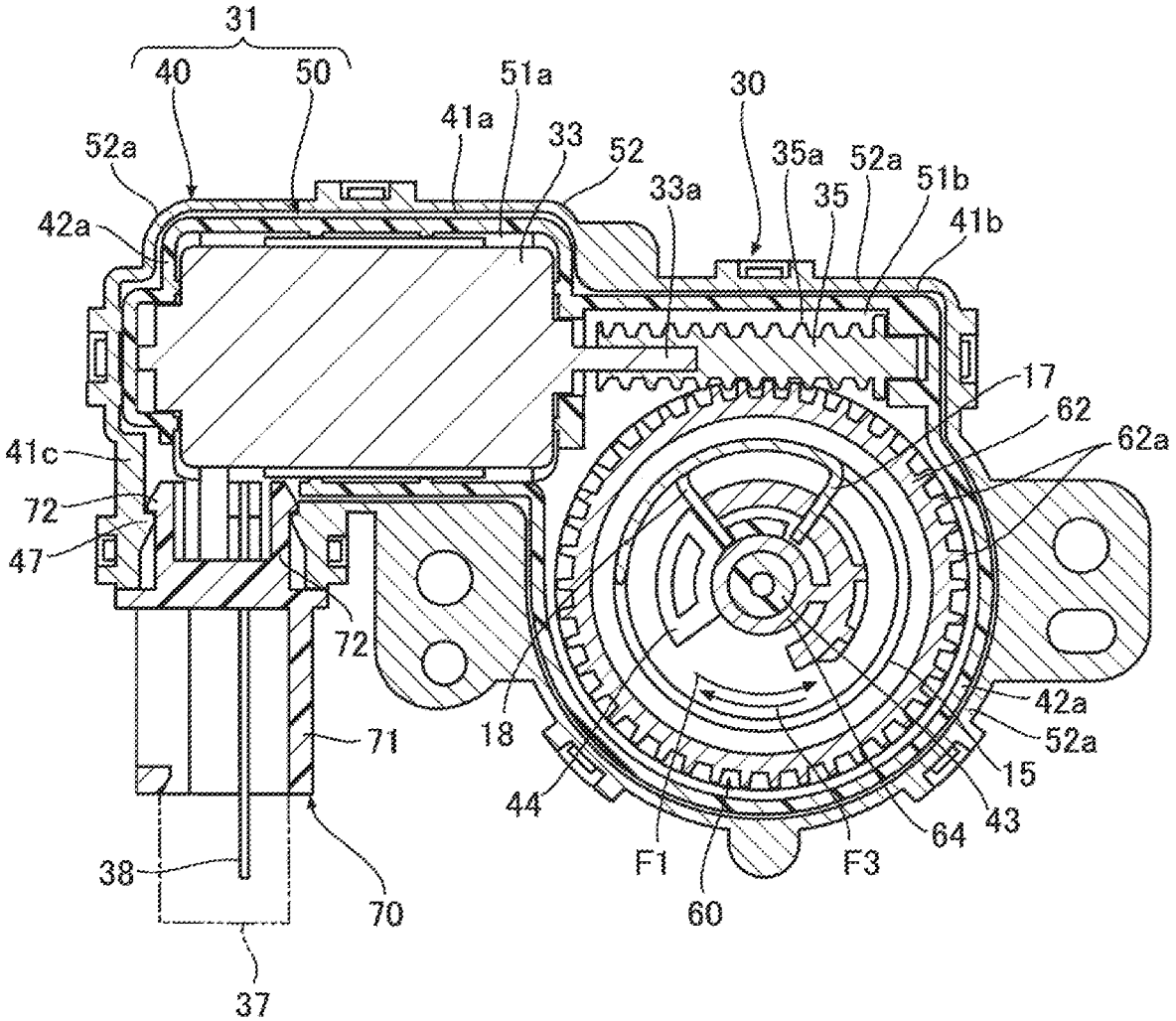
FIG. 7 is a sectional view of the actuator taken along a line indicated by arrows A in FIG. 4.

Referring to FIG. 7, as well, the first case 40 has a motor disposing portion 41*a* where the motor 33 is disposed and a worm gear disposing portion 41*b* which is provided adjacent to the motor disposing portion 41*a* at a side of the rotational shaft 33*a* of the motor 33 and where a worm gear (the worm 35 and the worm wheel 60) is disposed. In addition, a connector inserting portion 41*c* is provided at a side portion of the motor disposing portion 41*a* of the first case 40, and the power supply connector 37 (refer to FIG. 7) configured to supply electricity to the motor 33 is inserted into this connector inserting portion 41*c*. An engaging rib 47 is provided on an inner circumference of the connector inserting portion 41*c* so as to project therefrom along a circumferential direction of the connector inserting portion 41*c* (refer to FIG. 2). As shown in FIG. 7, this connector inserting portion 41*c* is disposed on the same side as the worm wheel 60 with respect to an axis of the worm 35 and in parallel to an axial direction of the worm 35.

In addition, as shown in FIG. 2, a projecting rib-shaped inner wall portion 42*a* is provided from an opening side end portion of the circumferential wall 42 of the first case 40 so as to surround a circumferential edge portion of the motor disposing portion 41*a* excluding the connector inserting portion 41*c* and a circumferential edge portion of the worm gear disposing portion 41*b*. Further, a plurality of engaging projecting portions 42*b* are provided on an outer circumference of the circumferential wall 42 so as to project therefrom at which the second case 50 is mounted on the first case 40.

A shaft portion 43 configured to support rotatably the worm wheel 60 is provided to project from a bottom wall 41 at a side of the worm gear disposing portion 41*b*. Additionally, a substantially arc-shaped spring locking projecting portion 44 and a stopper abutment wall portion 45 are provided on the bottom wall 41 so as to be erected therefrom while facing an outer circumference of the shaft portion 43, the stopper abutment wall portion 45 being disposed in a position adjacent to the spring locking projecting portion 44 in a circumferential direction. Further, an annular wall portion 46 is provided to be erected to outer circumferences of the spring locking projecting portion 44 and the stopper abutment wall portion 45. The torsion spring 15 is locked on the spring locking projecting portion 44 at one end portion 16 thereof (refer to FIG. 7).

On the other hand, the second case 50, which is mounted on the first case 40, is made up of a ceiling wall 51 and a circumferential wall 52 which is suspended perpendicularly from a circumferential edge of the ceiling wall portion 51 and is formed into the shape of a frame which is opened downwards.

Referring to FIG. 6, as well, a motor disposing portion 51*a*, a worm gear disposing portion 51*b* and a connector inserting portion 51*c* are provided on the second case 50 in positions corresponding to the positions where the motor disposing portion 41*a*, the worm gear disposing portion 41*b* and the connector inserting portion 41*c* are provided on the first case 40, respectively. Further, an engaging rib 57 is formed on an inner circumference of the connector inserting portion 51*c* so as to extend along a circumferential direction of the connector inserting portion 51*c*. A plurality of frame-shaped walls 52*b* are provided on an outer circumference of the circumferential wall 52 so as to project therefrom at which the second case 50 is mounted on the first case 40.

Figure 8:
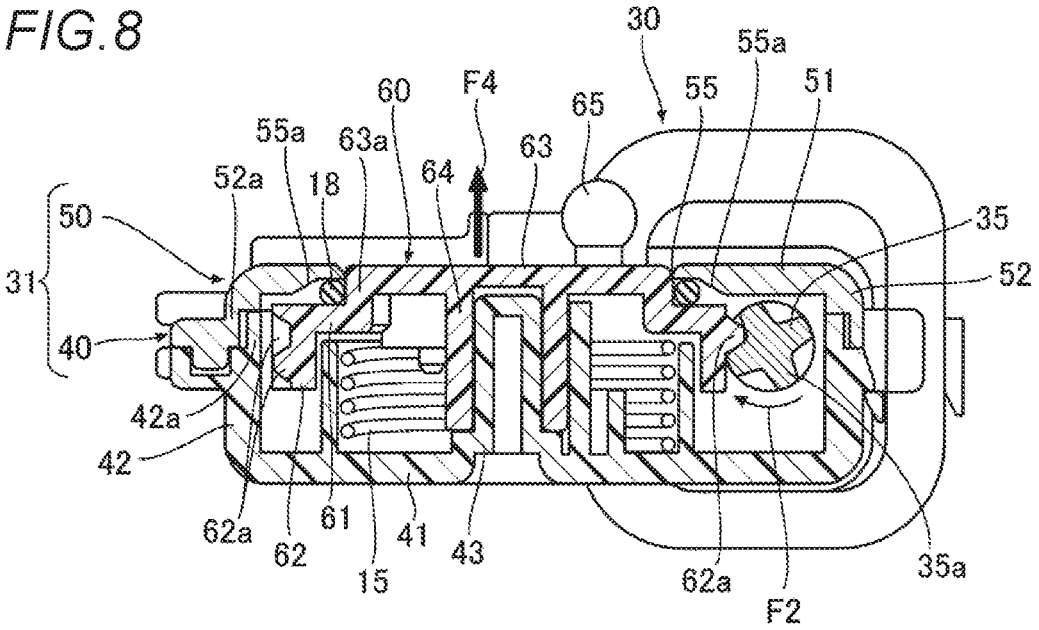
FIG. 8 is a sectional view of the actuator taken along a line indicated by arrows B in FIG. 4.

As shown in FIG. 2, a circular opening portion 55 is formed in the ceiling wall 51 at a side of the worm gear disposing portion 51*b* from which a rotating portion 63 of the worm wheel 60, which will be described later is allowed to project. As shown in FIG. 8, a tapered surface 55*a* is formed around a circumferential edge on a rear side of the opening portion 55 (an interior space side of the case), and this tapered surface 55*a* is inclined so as to gradually increase its thickness towards a circumferential wall 52 on an outer side of the opening portion.

Then, when the case 31 is built up by mounting the second case 50 on the first case 40 by bringing the plurality of frame-shaped walls 52*b* on the second case 50 into engagement with the plurality of engaging projecting portions 42*b* on the first case 40, a disposing space for the motor 33 is provided by the motor disposing portions 41*a*, 51*a* to define, and a disposing space for the worm gear (the worm 35 and the worm wheel 60) is provided by the worm gear disposing portions 41*b*, 51*b*. Additionally, a cylindrical connector inserting portion into which the power supply connector 37 is inserted is provided by the connector inserting portions 41*c*, 51*c*.

Figure 9:
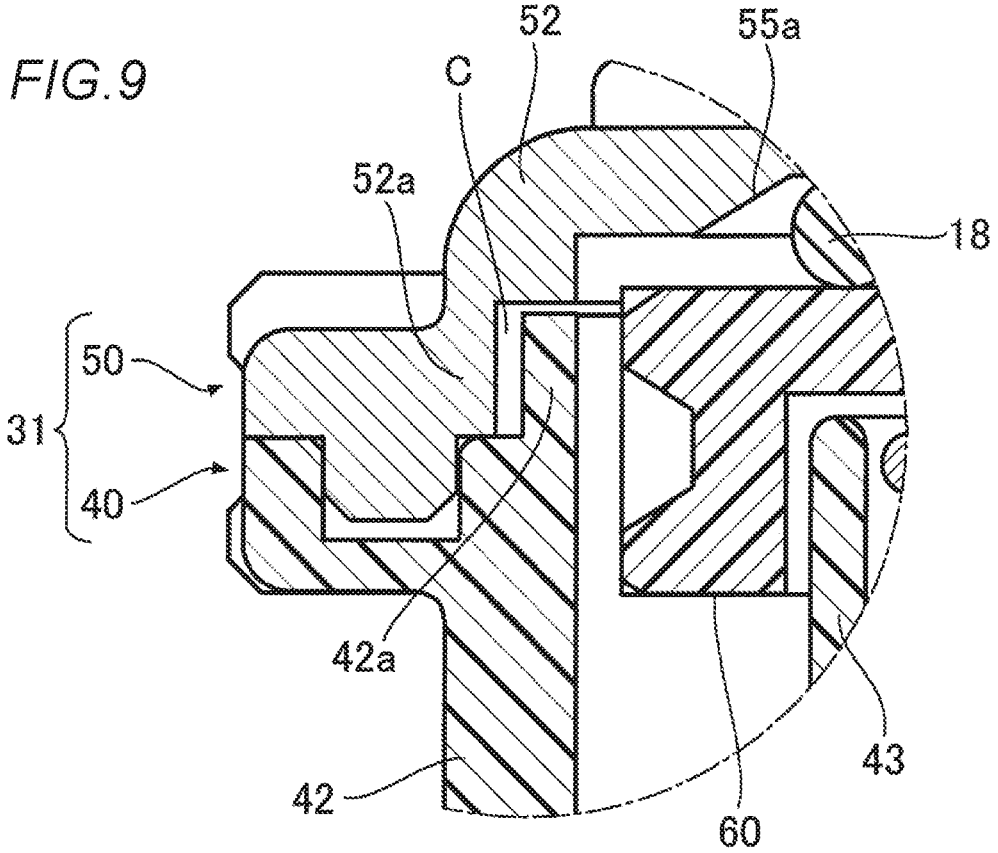
FIG. 9 is a partially enlarged view of FIG. 8.

In addition, as shown in FIG. 7, a part of the circumferential wall 52 of the second case 50, that is, a circumferential edge portion of the motor disposing portion 51*a* excluding the connector inserting portion 51*c* and a portion surrounding a circumferential edge of the worm gear disposing portion 51*b* make up an outer wall portion 52*a*. This outer wall portion 52*a* is disposed on an outer side of the inner wall portion 42*a* of the circumferential wall 42 of the first case 40 via a predetermined gap C, as shown in FIGS. 8 and 9, with the second case 50 mounted on the first case 40 as described above.

Next, the worm wheel 60 which is supported rotatably on the shaft portion 43 of the case 31 will be described. As shown in FIGS. 2, 6 and 8, this worm wheel 60 has an annular base portion 61 and an annular wall portion 62 provided to be erected from a circumferential edge of the base portion 61 and having teeth 62*a* formed on an outer circumference thereof so as to mesh with teeth 35*a* of the worm 35.

Figure 4:
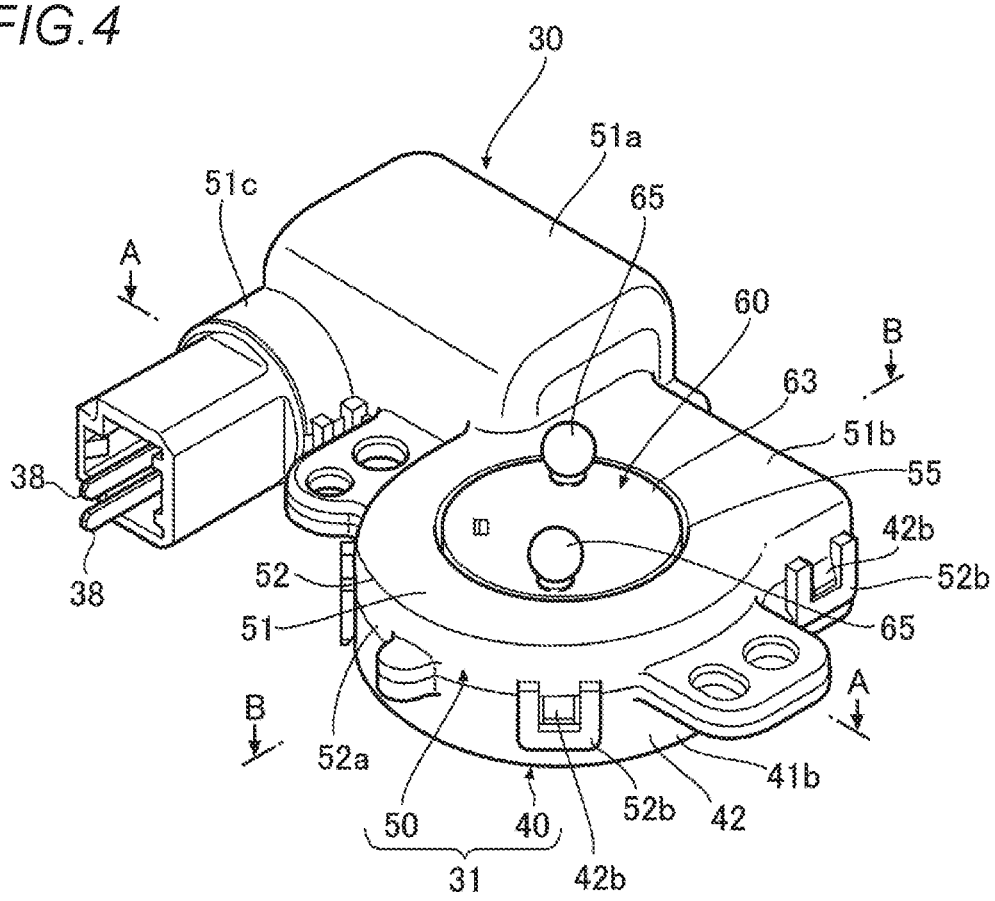
FIG. 4 is a perspective view of the actuator.

In addition, as shown in FIGS. 2 and 8, a vertical wall 63*a* is provided to be erected from an inner circumferential edge of the base portion 61, and the rotating portion 63 having a circular disc shape projects outwards of the case from the opening portion 55 of the case 31. As shown in FIGS. 4 and 8, this rotating portion 63 is inserted into an inner circumference of the opening portion 55, and the vertical wall 63*a* thereof is disposed so as to be brought into sliding contact with the inner circumference of the opening portion 55, whereby the rotation of the worm wheel 60 is guided. The rotating portion 63 is exposed visually from the opening portion 55.

Figure 3:
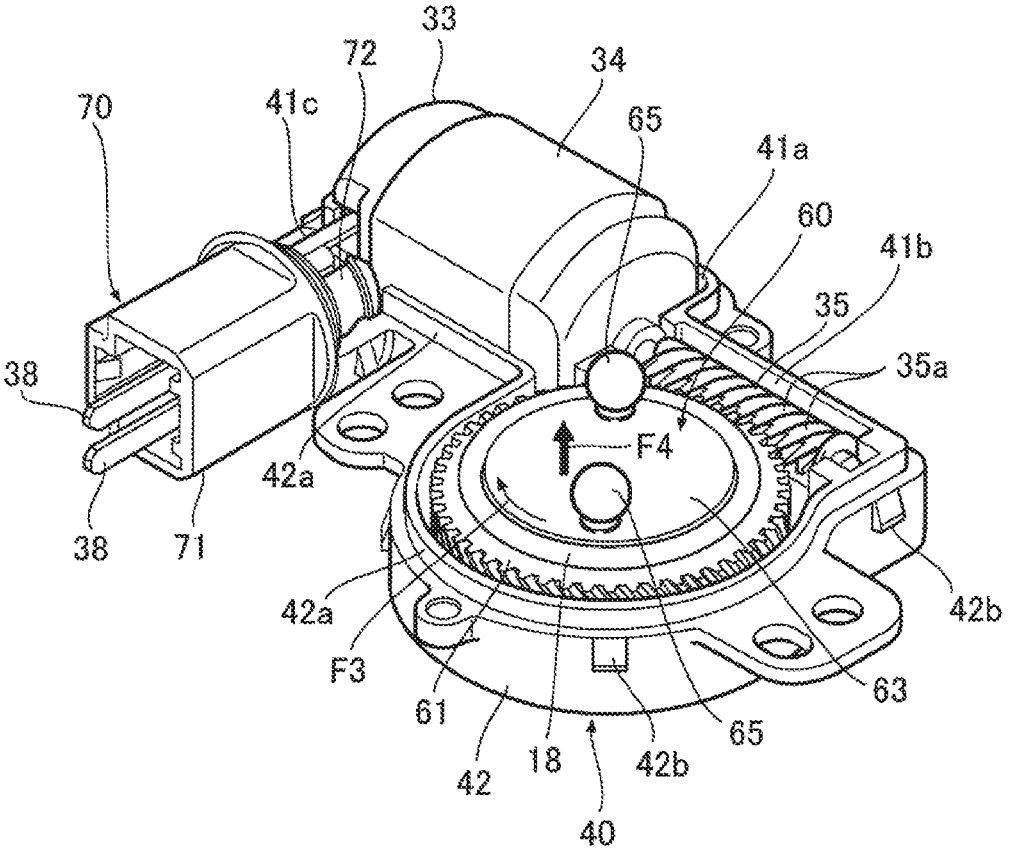
FIG. 3 is a perspective view of an actuator which makes up the electric locking device.

Further, as shown in FIG. 3, an O-shaped seal ring 18 is disposed on an outer circumference of the vertical wall 63*a* of the rotating portion 63, and the seal ring 18 is supported by the base portion 61. As a result of this, as shown in FIG. 8, the seal ring 18 is interposed between a rear circumferential edge of the opening portion 55 of the second case 50 and a portion of the worm wheel 60 which faces the rear circumferential edge of the opening portion 55.

As shown in FIG. 8, a cylindrical support portion 64 is provided to project a predetermined length from a center of a rear side of the rotating portion 63 (the interior space side of the case). The shaft portion 43 of the first case 40 is inserted into this support portion 64, whereby the worm wheel 60 is supported rotatably (refer to FIG. 8). In this state, as shown in FIG. 8, the annular wall portion 46 of the first case 40 is disposed so as to be brought into sliding contact with an inner circumference of the annular wall portion 62 of the worm wheel 60, which also guides the rotation of the worm wheel 60.

Figure 11:
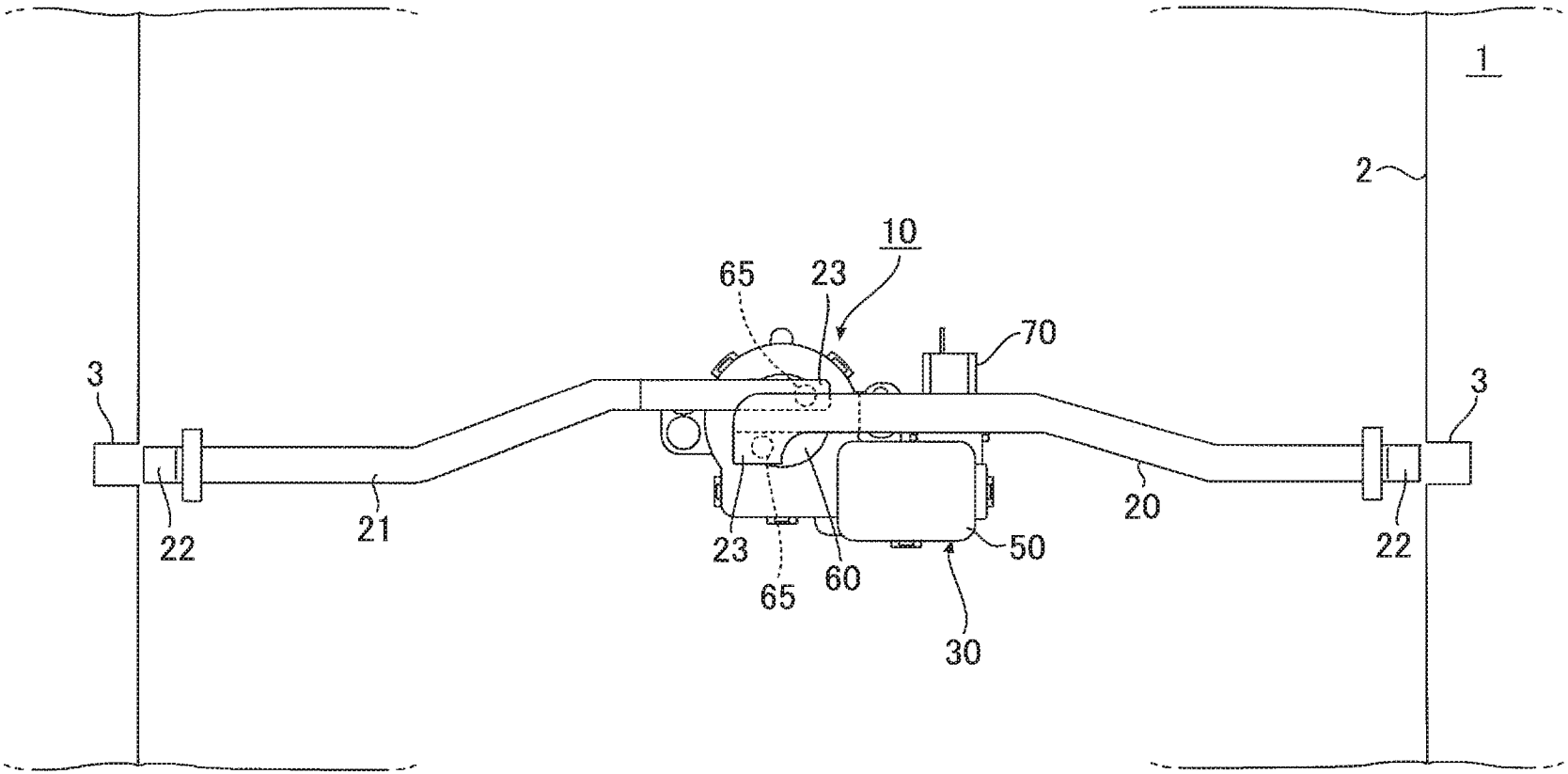
FIG. 11 is an explanatory view showing a state in which an openable/closable member is opened by the electric locking device.

In the electric locking device for an openable/closable member of the invention, the proximal end portions of the pair of rods are assembled individually to the rotating portion 63. In this embodiment, as shown in FIG. 4, a pair of rod pivotally supporting portions 65, 65, which protrude into a spherical shape at distal ends thereof, are provided at locations which diametrically face each other with respect to a rotational center of the rotating portion 63 on a front surface side of the rotating portion 63 (a side which projects outwards of the case) so as to project therefrom. Then, the pair of rod pivotally supporting portions 65, 65 are inserted individually into the proximal end portions 23, 23 of the pair of rods 20, 21 while being prevented from being dislocated therefrom and the proximal end portions 23, 23 of the pair of rods 20, 21 are pivotally supported individually at locations which diametrically face each other with respect to a rotational center of the rotating portion 63. By doing so, the pair of rods 20, 21 are configured to slide in opposite directions to each other in a synchronized fashion when the worm wheel 60 rotates (refer to FIG. 11).

As shown in FIG. 6, a spring locking projecting portion 66 is provided on an outer circumference of the support portion 64 on a rear surface side of the rotating portion 63 so as to project therefrom. Then, as shown in FIG. 7, the torsion spring 15 which is held by the spring locking projecting portion 44 of the first case 40 at the one end portion 16 is locked on the spring locking projecting portion 66 at the other end portion 17 thereof (refer to FIG. 6). As a result of this, the worm wheel 60 is rotationally biased in a direction indicated by an arrow F1 in FIGS. 7 and 10, whereby the engaging portions 22, 22 of the pair of rods 20, 21 are biased in directions in which the engaging portions 22, 22 are brought into engagement with the locking portions 3, 3.

As a biasing structure of the engaging portions 22, 22 of the rods 20, 21, for example, one or both of the rods 20, 21 may be biased to slide by the use of a tension spring, and hence, there is imposed no specific limitation. As this occurs, the tension spring constitutes a "biasing means" of the invention.

With the engaging portions 22, 22 of the pair of rods 20, 21 biased in the directions in which the engaging portions 22, 22 are brought into engagement with the locking portions 3, 3, when the switch 7 is operated, causing the rotational shaft 33*a* of the motor 33 and the worm 35 to rotate and to rotate in a direction indicated by an arrow F2 (refer to FIG. 8), respectively, the worm wheel 60 rotates in a direction indicated by arrow F3 (an opposite direction to the rotational biasing direction) shown in FIGS. 7 and 10 in association with the rotation of the rotational shaft 33*a* and the worm 35, whereby the engaging portions 22, 22 of the pair of rods 20, 21 are caused to slide in directions in which the engaging portions 22, 22 are disengaged from the locking portions 3, 3 against the biasing force of the torsion spring 15.

As this occurs, a force is applied to the worm wheel 60 in a floating direction from the bottom wall 41 of the first case 40 as indicated by an arrow F4 in FIGS. 3 and 8 due to a pressing force imparted to the teeth 62*a* of the worm wheel 60 from the worm 35, whereby the worm wheel 60 is pressed against the seal ring 18.

As shown in FIG. 6, a stopper mounting projecting portion 67 is provided on an outer circumference of the support portion 64 on the rear side of the rotating portion 63 of the worm wheel 60 so as to project therefrom with a predetermined space provided in a circumferential direction from the spring locking projecting portion 66. A substantially cylindrical stopper 36 formed of an elastic material such as rubber or elastic elastomer is mounted on this stopper mounting projecting portion 67. This stopper 36 is brought into abutment with the stopper abutment wall portion 45 of the case 31 to restrict a rotation of the worm wheel 60 when the worm wheel 60 rotates.

Further, the electric locking device 10 includes a connector case 70 into which the power supply connector 37 is inserted.

The connector case 70 of this embodiment is a separate member from the case 31 and is detachably attached to the case 31. The connector case 70 has a substantially angularly cylindrical shape as shown in FIG. 2 and has an inserting portion 71 into which the power supply connector 37 is inserted and a pair of engaging claws 72, 72 which are provided to extend from a distal end side of the inserting portion 71 so as to deflect. Additionally, an O-ring 19 is mounted on a proximal end side of the pair of engaging claws 72, 72 (refer to FIG. 6).

Consequently, when the connector case 70 is inserted into the connector inserting portion (the connector inserting portions 41*c*, 51*c*) of the case 31, the engaging claws 72, 72 are brought into engagement with the engaging ribs 47, 57, and the O-ring 19 is brought into tight contact with an inner circumference of the connector inserting portion of the case 31, whereby the connector case 70 is attached to the case 31 while being prevented from being dislocated therefrom with a gap defined between the connector inserting portion and the connector case 70 being tightly closed.

This connector case 70 is disposed on the same side as the worm wheel 60 with respect to the worm 35 and in parallel to an axial direction of the worm 35, as shown in FIGS. 6 and 7.

Although not particularly shown, the angularly cylindrical inserting portion 71 includes a support plate having a pair of support holes for supporting a bus bar on an inner circumference of a distal end thereof, and a pair of bus bars 38, 38 are inserted through the pair of support holes of the support plate so as to be supported therein. In this way, the bus bars 38, 38 are incorporated within the connector case 70. Then, when the connector case 70 is attached to the connector connecting portion of the case 31, the pair of bus bars 38, 38 are connected to the motor 33. In this state, the power supply connector 37 is inserted into the inserting portion 71 of the connector case 70 so as to be connected to the bus bars 38, 38, whereby the power supply connector 37 is connected to the motor 33, allowing the supply connector 37 to electrically communicate with the motor 33.

Further, this electric locking device 10 has a holding means for holding the engaging portions 22, 22 of the rods 20, 21 in such a state that the engaging portions 22, 22 are not brought into engagement with the locking portions 3, 3 against the biasing force of the torsion spring 15 when the worm wheel 60 rotates, causing the engaging portions 22, 22 of the pair of rods 20, 21 to slide in directions in which the engaging portions 22, 22 are disengaged from the pair of locking portions 3, 3 and releasing the holding of the engaging portions 22, 22 of the rods 20, 21 to cause the engaging portions 22, 22 to slide in directions in which the engaging portions 22, 22 are brought into engagement with the locking portions 3, 3 when the openable/closable member 5 is closed relative to the opening portion 2 in the fixed member 1.

Figure 12:
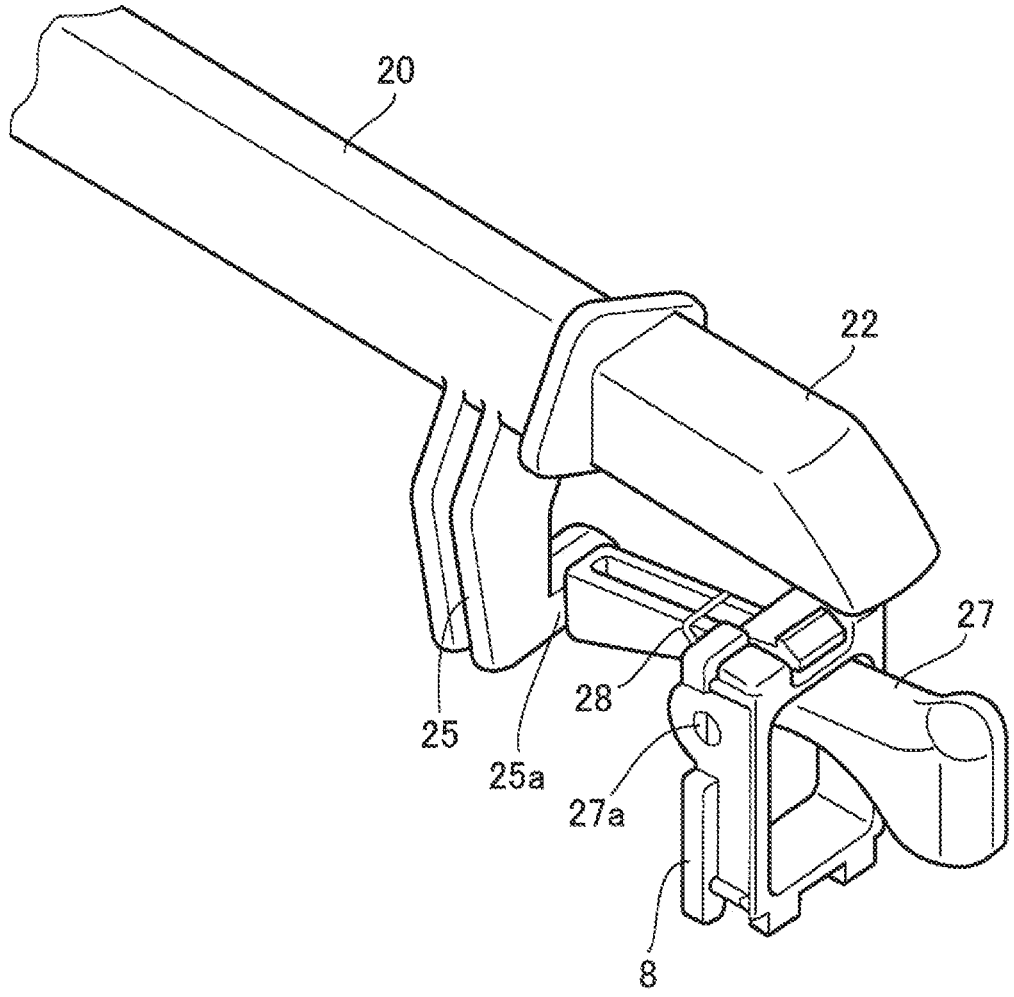
FIG. 12 is an enlarged perspective view of an essential part of the electric locking device showing a holding means for the rod.
Figure 13:
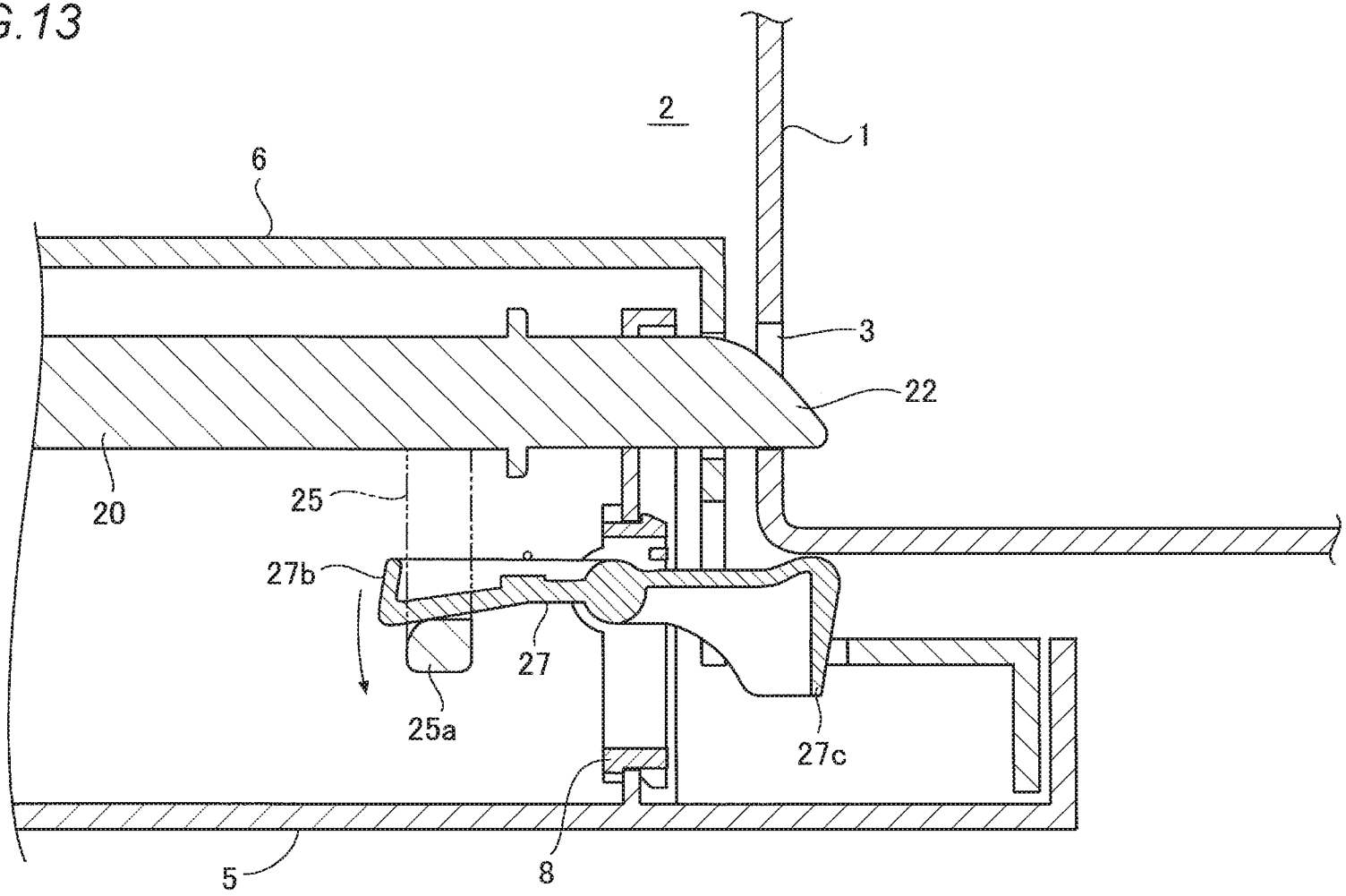
FIG. 13 is an enlarged explanatory view of the essential part showing a state in which the rod is not held in the holding means.
Figure 14:
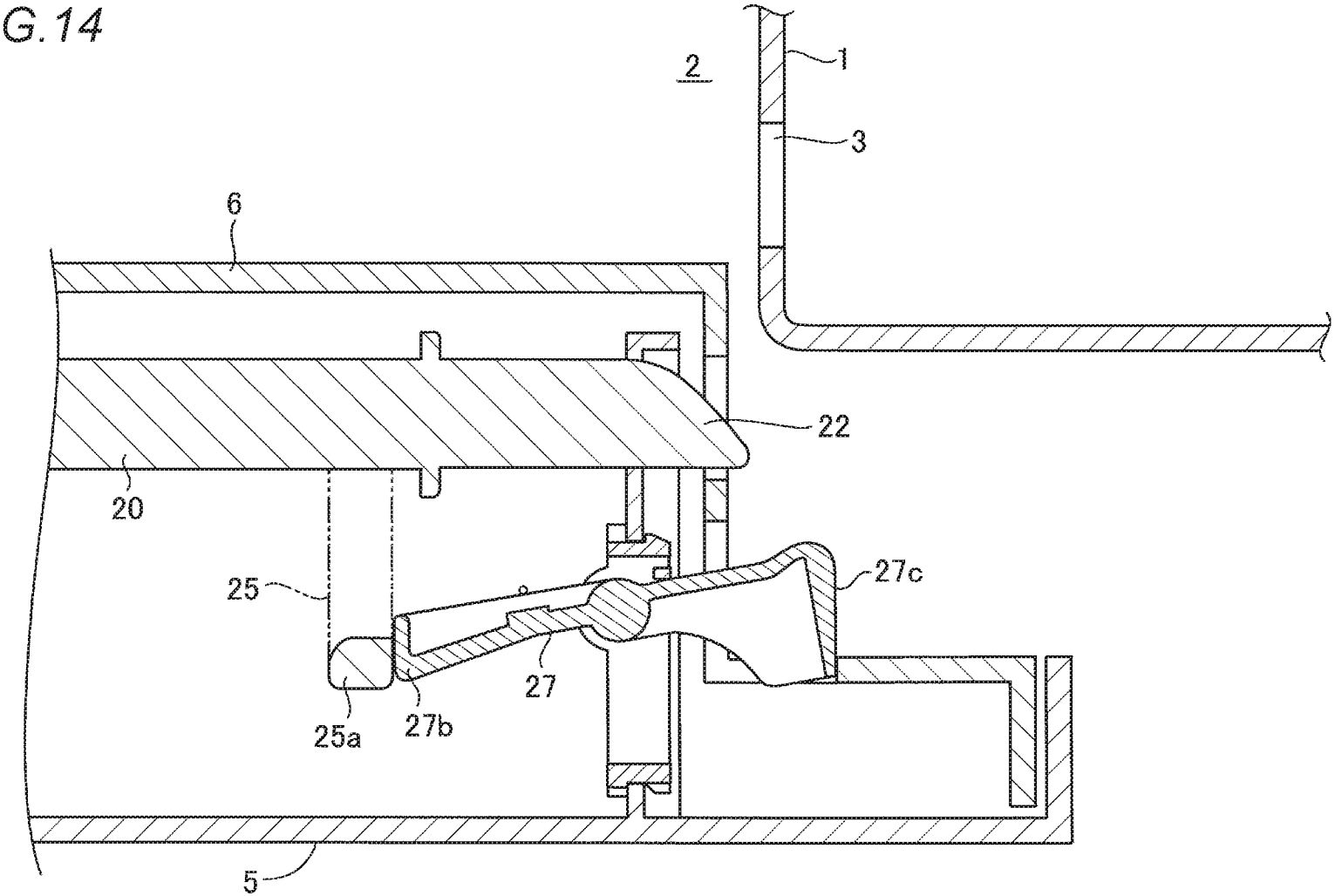
FIG. 14 is an enlarged explanatory view of the essential part showing a state in which the rod is held by the holding means.

To describe this by reference to FIGS. 12 to 14, a holding arm 25, which is bent into a substantially L-shape, is provided at an axial distal end portion of the rod 20 so as to extend therefrom. Additionally, a frame-shaped holding frame 8 is provided fixedly at one side portion of a box 6 which is provided on an inner surface of the openable/closable member 5 (refer to FIG. 13), and a lever 27 is mounted in the holding frame 8 via a pivot shaft 27*a* (refer to FIG. 12). A proximal end portion 27*b* side of the lever 27 is rotationally biased towards a front surface side of the openable/closable member 5 by a spring 28 (refer to an arrow in FIG. 13).

Further, as shown in FIG. 13, the proximal end portion 27*b* of the lever 27 is disposed to ride on an inner surface of a distal end portion 25*a* of the holding arm 25 at a side of the rod 20 in such a state that the engaging portions 22, 22 of the pair of rods 20, 21 are biased by the torsion spring 15 in the directions in which the engaging portions 22, 22 are brought into engagement with the locking portions 3, 3.

Then, when the worm wheel 60 rotates, causing the locking portions 22, 22 of the pair of rods 20, 21 to slide in the directions in which the engaging portions 22, 22 are disengaged from the locking portions 3, 3, the lever 27 rotates via the pivot shaft 27*a* against a biasing force of the spring 28, and the proximal end portion 27*b* of the lever 27 is brought into engagement with an outer surface of the distal end portion 25*a* of the holding arm 25 at a side of the engaging portion 22, whereby the engaging portion 22 of the rod 20 is held in such a state that the engaging portion 22 is not in engagement with the locking portion 3 (refer to FIG. 14). Namely, in this embodiment, the holding arm 25 of the rod 20 and the lever 27 of the holding frame 8 constitute a "holding means" of the invention. In this embodiment, in case the engaging portion 22 of the rod 20 is held in such a state that the engaging portion 22 is not in engagement with the locking portion 3, the rod 21 slides in a synchronized fashion via the worm wheel 60, so that the engaging portion 22 of the rod 21 is held in such a state that the engaging portion 22 is not in engagement with the locking portion 3.

Further, when the openable/closable member 5 is closed, a distal end portion 27*c* of the lever 27 is brought into abutment with a front circumferential edge portion of the opening portion 2 in the fixed member 1, causing the lever 27 to rotate, and the proximal end portion 27*b* of the lever 27 is disengaged from the distal end portion 25*a* of the holding arm 25, whereby the holding of the engaging portions 22, 22 of the pair of rods 20, 21 is released. It should be noted that the holding means is not limited to the structure described above.

Next, working effects of the electric locking device 10 structured as has been described heretofore will be described.

Namely, when the openable/closable member 5 is pushed in relative to the opening portion 2 to close the opening portion 2 in the fixed member 1, the tapered surfaces of the engaging portions 22, 22 of the pair of rods 20, 21 are pressed against the inner surfaces on both the sides of the opening portion 2, whereby the pair of rods 20, 21 are drawn inwards of the openable/closable member 5 against the biasing force of the torsion spring 15. Then, when the engaging portions 22, 22 arrive at the corresponding locking portions 3, 3, the worm wheel 60 is rotationally biased due to the biasing force of the torsion spring 15, and the rods 20, 21 are pushed out towards the outside of the openable/closable member 5, whereby the engaging portions 22, 22 are individually brought into engagement with the locking portions 3, 3, thereby making it possible to lock the openable/closable member 5 in such a state that the opening portion 2 in the fixed member 1 is closed by the openable/closable member 5 (refer to FIGS. 1(*a*) and 10).

Then, when the openable/closable member 5 is opened from the opening portion 2 in the fixed member 1, the switch 7 on the front surface side of the openable/closable member 5 is operated. Then, electricity is supplied to the motor 33 through the bus bars 38 from the power supply connector 37 which is connected to a power supply, not shown, whereby not only does the rotational shaft 33*a* of the motor 33 rotate, but also the worm 35 rotates in the direction indicated by the arrow F2 (refer to FIG. 8). Then, in association with the rotation of the worm 35, the worm wheel 60 rotates in the direction indicated by the arrow F3 shown in FIGS. 7 and 10. As a result of this, the engaging portions 22, 22 of the pair of rods 20, 21 slide in the directions in which the engaging portions 22, 22 are disengaged from the corresponding locking portions 3, 3 against the biasing force of the torsion spring 15, whereby the engagement of the engaging portions 22 with the locking portions 3 is released. Thus, the opening portion 22 in the fixed member 1 can be opened by moving the openable/closable member 5 away from the opening portion 2 in the fixed member 1.

Then, in this electric locking device 10, as shown in FIG. 4, the worm wheel 60 has the rotating portion 63 which projects outwards of the case 31 from the opening portion 55 in the case 31, and the proximal end portions 23, 23 of the pair of rods 20, 21 are assembled individually to the rotating portion 63 in association with each other. In this embodiment, the proximal end portions 23, 23 of the pair of rods 20, 21 are pivotally supported individually on the rod pivotally supporting portions 65, 65 provided on the rotating portion 63 (refer to FIG. 5). Because of this, since the pair of rods 20, 21 can be interlocked directly with the pair of rods 20, 21, the number of parts involved can be reduced when compared with the construction of the locking device of Patent Document 1 (JP-A-2013-234742) described above in which in addition to the actuator and the pair of locking members, the link for the pair of locking members is provided, thereby making it possible to simplify the construction of the electric locking device 10.

In particular, in this embodiment, the pair of rods 20, 21 can be assembled to the worm wheel 60 by a simple operation in which the proximal end portions 23, 23 of the pair of rods 20, 21 are pushed in relative to the rod pivotally supporting portions 65, 65 of the rotating portion 63 of the worm wheel 60 to be supported pivotally thereon, thereby making it possible to improve the workability in assembling the rods 20, 21 to the rotating portion 63 of the worm wheel 60.

In this embodiment, as shown in FIG. 8, since the seal ring 18 is interposed between the rear circumferential edge of the opening portion 55 in the case 31 and the portion of the worm wheel 60 which faces the rear circumferential edge of the opening portion 55, the gap between the case 31 and the worm wheel 60 can be sealed up, thereby making it possible to suppress the leakage of noise from the opening portion 55 in the case 31 as much as possible. Further, since the seal ring 18 functions as a damper when the worm wheel 60 rotates, it is possible to suppress the generation of striking noise which occurs when the engaging portions 22, 22 of the pair of rods 20, 21 are biased again by the biasing means (the torsion spring 15) after the engaging portions 22, 22 of the pair of rods 20, 21 are caused to slide in the directions in which the engaging portions 22, 22 are disengaged from the pair of locking portions 3, 3.

In this embodiment, as shown in FIG. 9, the case 31 is made up of the first case 40 and the second case 50 which is mounted on the first case 40, and the outer wall portion 52*a* of the circumferential wall 52 of the second case 50 is disposed on the outer side of the inner wall portion 42*a* of the circumferential wall 42 of the first case 40 via the predetermined gap C in such a state that the second case 50 is mounted on the first case 40. Therefore, it is possible to suppress the leakage of noise (working noise of the motor 33, meshing noise of the worm gear or the like) generated within the case 31 to the outside of the case 31.

In this embodiment, when the engaging portions 22, 22 of the pair of rods 20, 21 are caused to slide in the directions in which the engaging portions 22, 22 are disengaged from the pair of locking portions 3, 3 by rotating the worm wheel 60 via the worm 35 to release the locking of the openable/closable member 5, the worm wheel 60 is designed to be pressed against the seal ring 18 due to the pressing force imparted to the teeth of the worm wheel 60 from the worm 35. Therefore, it is possible to suppress more effectively the leakage of the working noise of the motor 33, the meshing noise of the worm 35 with the worm wheel 60 or the like from the opening portion 55.

Incidentally, in a locking device like the electric locking device 10 having the structure in which the worm wheel 60 is rotated via the worm 35, since the teeth 35*a* of the worm 35 mesh with the teeth 62*a* of the worm wheel 60, a relatively great biasing force is necessary when the pair of rods 20, 21 are biased again after the engaging portions 22, 22 of the pair of rods 20, 21 are caused to slide in the directions in which the engaging portions 22, 22 are disengaged from the locking portions 3, 3 to open the openable/closable member 5.

However, in the case where the biasing force of the biasing means is increased, when attempting to cause the pair of rods 20, 21 to be drawn in manually by pressing the tapered surfaces of the engaging portions 22, 22 of the rods 20, 21 against the inner surfaces of the opening portion 2 to close the openable/closable member 5, since the openable/closable member 5 needs to be pushed in forcibly, a bad closing feel is sensed by an operator.

In contrast with this, in this embodiment, as shown in FIGS. 12 to 14, when the engaging portions 22, 22 of the pair of rods 20, 21 are caused to slide in the directions in which the engaging portions 22, 22 are disengaged from the pair of locking portions 3, 3, the proximal end portions 27*b* of the levers 27 are brought into engagement with the outer surfaces of the distal end portions 25*a* of the holding arms 25, and the engaging portions 22, 22 of the pair of rods 20, 21 are held in such a state that the engaging portions 22, 22 are not brought into engagement with the locking portions 3, 3. Then, when the openable/closable member 5 is closed relative to the opening portion 2 in the fixed member 1 and the distal end portions 27*c* of the levers 27 are brought into abutment with the front circumferential edge portions of the opening portion 2 in the fixed member 1, the levers 27 rotate, and the proximal end portions 27*b* are disengaged from the distal end portions 25*a* of the holding arms 25, whereby the holding of the engaging portions 22, 22 of the pair of rods 20, 21 is released, so that the engaging portions 22, 22 of the pair of rods 20, 21 are allowed to slide in the directions in which the engaging portions 22, 22 are brought into engagement with the pair of locking portions 3, 3.

Namely, in this embodiment, when the engaging portions 22, 22 of the pair of rods 20, 21 are caused to slide in the directions in which the engaging portions 22, 22 are disengaged from the pair of locking portions 3, 3, the rods 20, 21 are restricted from being returned due to the biasing force of the biasing means (the torsion spring 15) by the holding means (the holding arms 25, the holding frames 8 and the levers 27), so that the engaging portions 22, 22 can be held in the state in which the engaging portions 22, 22 are caused to slide in the disengaging direction. On the other hand, when the openable/closable member 5 is closed, the holding of the engaging portions 22, 22 by the holding means is released to allow the pair of rods 20, 21 to be pushed out. Thus, it is possible to improve the closing feel sensed by the operator when he or she closes the openable/closable member 5.

In this embodiment, the connector case 70 into which the power supply connector 37 is inserted is provided. Additionally, as shown in FIGS. 6 and 7, since this connector case 70 is disposed on the same side as the worm wheel 60 with respect to the axis of the worm 35 and in parallel to the axial direction of the worm 35, the actuator 30 can be shaped compact as a whole when compared with a structure in which the connector house 70 and the worm wheel 60 are disposed on opposite sides to each other with respect to the axial direction of the worm 35.

In this embodiment, since the connector case 70 is the separate member from the case 31 and is detachably attached to the case 31, even though a power supply connector 37 of a different shape is used, the case 31 of the actuator 30 does not have to be redesigned, thereby making it possible to enhance the general purpose property of the case 31.

Figure 15A:
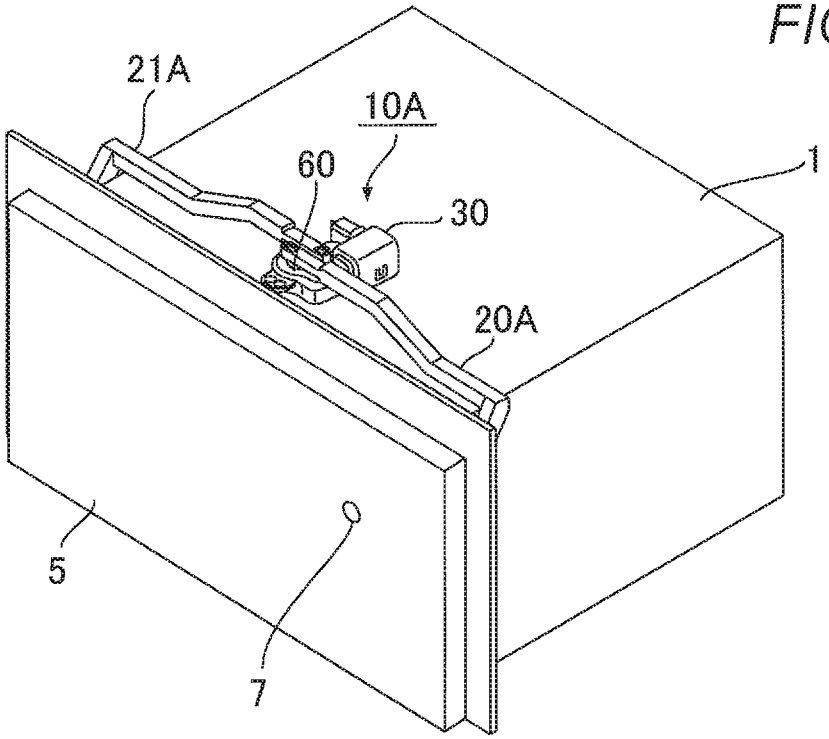
Figure 15B:
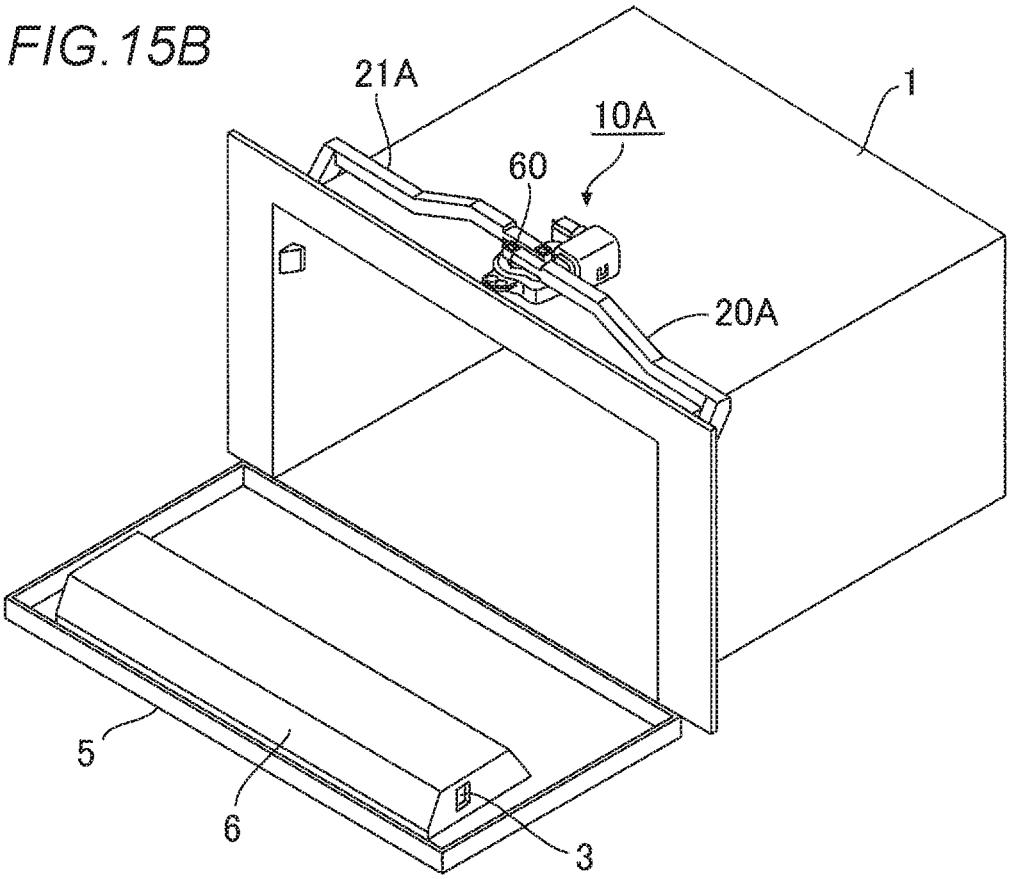
Figure 16:
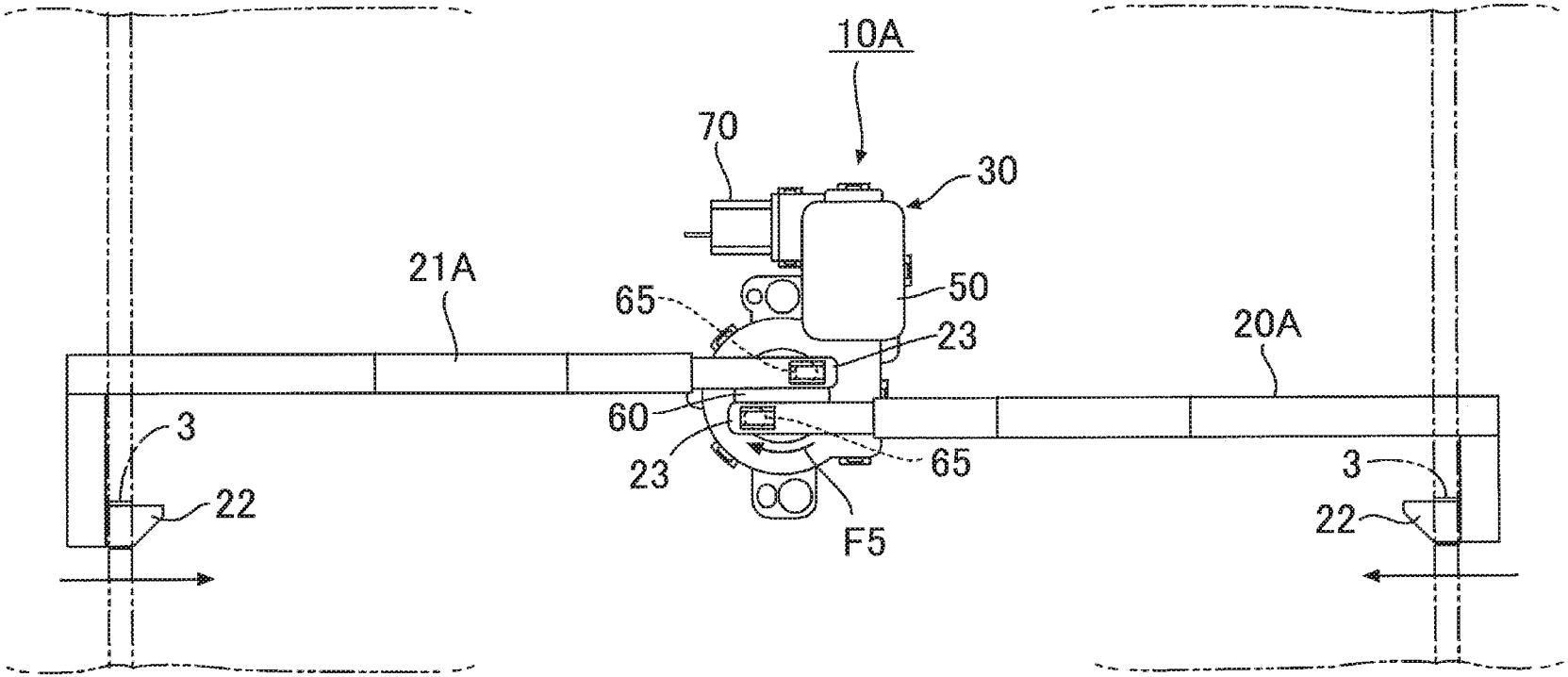
FIG. 16 is an explanatory view showing a state in which the openable/closable member is closed by the electric locking device.
Figure 17:
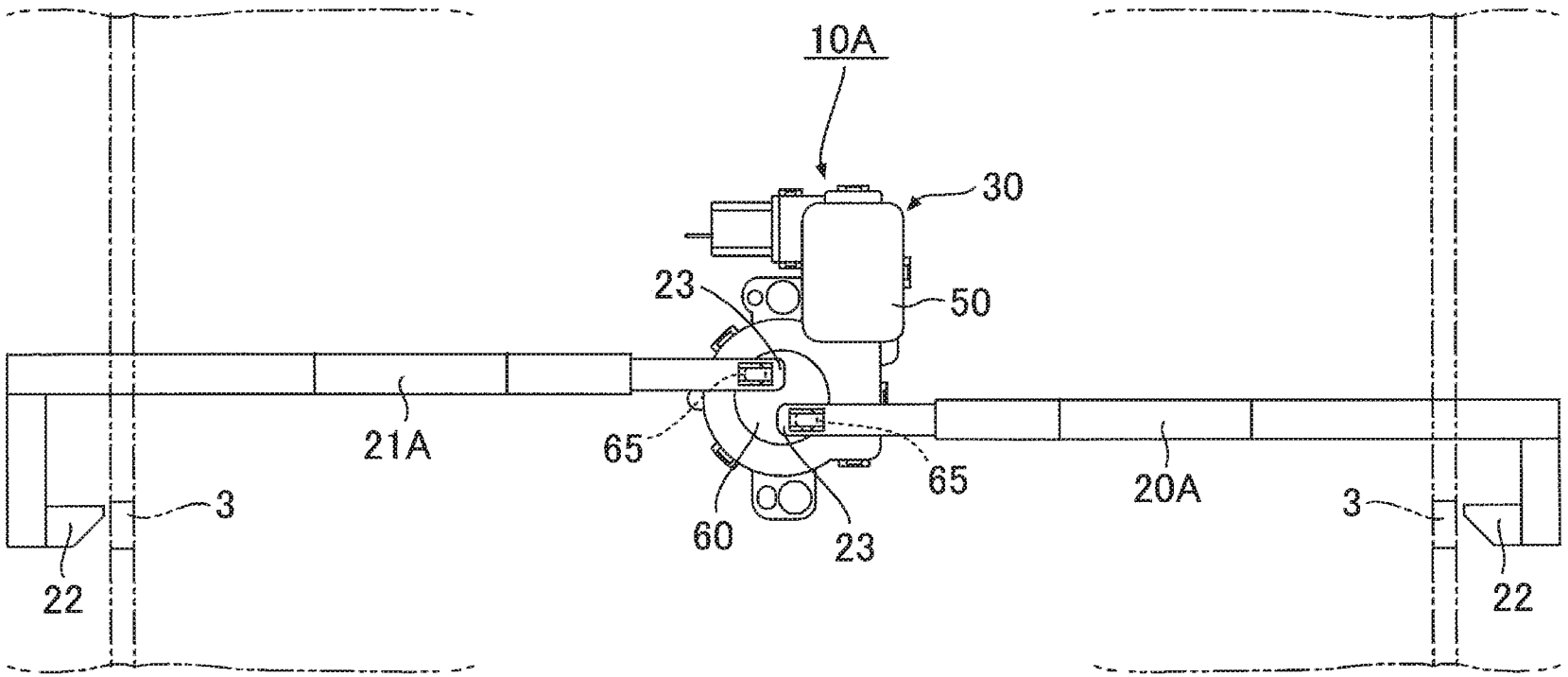
FIG. 17 is an explanatory view showing a state in which the openable/closable member is opened by the electric locking device.

FIGS. 15 to 17 show another embodiment of an electric locking device 10A for an openable/closable member according to the invention. It should be noted that like reference numerals will be given to portions which are substantially like to those of the embodiment described above, and the description thereof will be omitted here.

As shown in FIG. 15, an electric locking device 10A for an openable/closable member (hereinafter, referred to as an "electric locking device 10A") of this embodiment differs from the embodiment described above in the shape of rods and layout of an actuator 30 and rods when compared with the embodiment described above.

Namely, as shown in FIG. 15, the actuator 30 is attached to an upper surface side of a fixed member 1. In the actuator 30, a worm wheel 60 is disposed so as to be oriented towards an opening portion 2 in the fixed member 1 (an openable/closable member 5). On the other hand, locking portions 3, 3 are provided at both longitudinal side portions of a box 6 on the openable/closable member 5.

In a pair of rods 20A, 21A, axially distal end sides are bent substantially into an L-shape and are further bent back towards proximal end portions of the rods. The bent back portions constitute engaging portions 22, 22. As shown in FIG. 15(*b*), the engaging portions 22, 22 of the rods 20A, 21A are disposed so as to be pushed out and into the opening portion 2 in the fixed member 1. In addition, as shown in FIG. 16, the worm wheel 60 is biased rotationally in a direction indicated by an arrow F5 by a biasing means, not shown, whereby the engaging portions 22, 22 of the pair of rods 20A, 21A are biased in directions in which the engaging portions 22, 22 are brought into engagement with the locking portions 3, 3 on the openable/closable member's side.

In the electric locking device 10 of the embodiment described above, the pair of rods 20, 21 are disposed so as to be at right angles to the connector case 70 (refer to FIG. 10). In contrast with this, in the electric locking device 10A of this embodiment, the pair of rods 20A, 21A are disposed almost parallel to a connector case 70 (refer to FIG. 16).

Then, in this embodiment, when a switch 7 is operated, the worm wheel 60 rotates in an opposite direction to the direction indicated by the arrow F5, and the engaging portions 22, 22 of the pair of rods 20A, 21A are disengaged from the locking portions 3, 3 (refer to FIG. 17), whereby as shown in FIG. 15(*b*), the openable/closable member 5 can be opened from the opening portion 2 in the fixed member 1.

Figure 18:
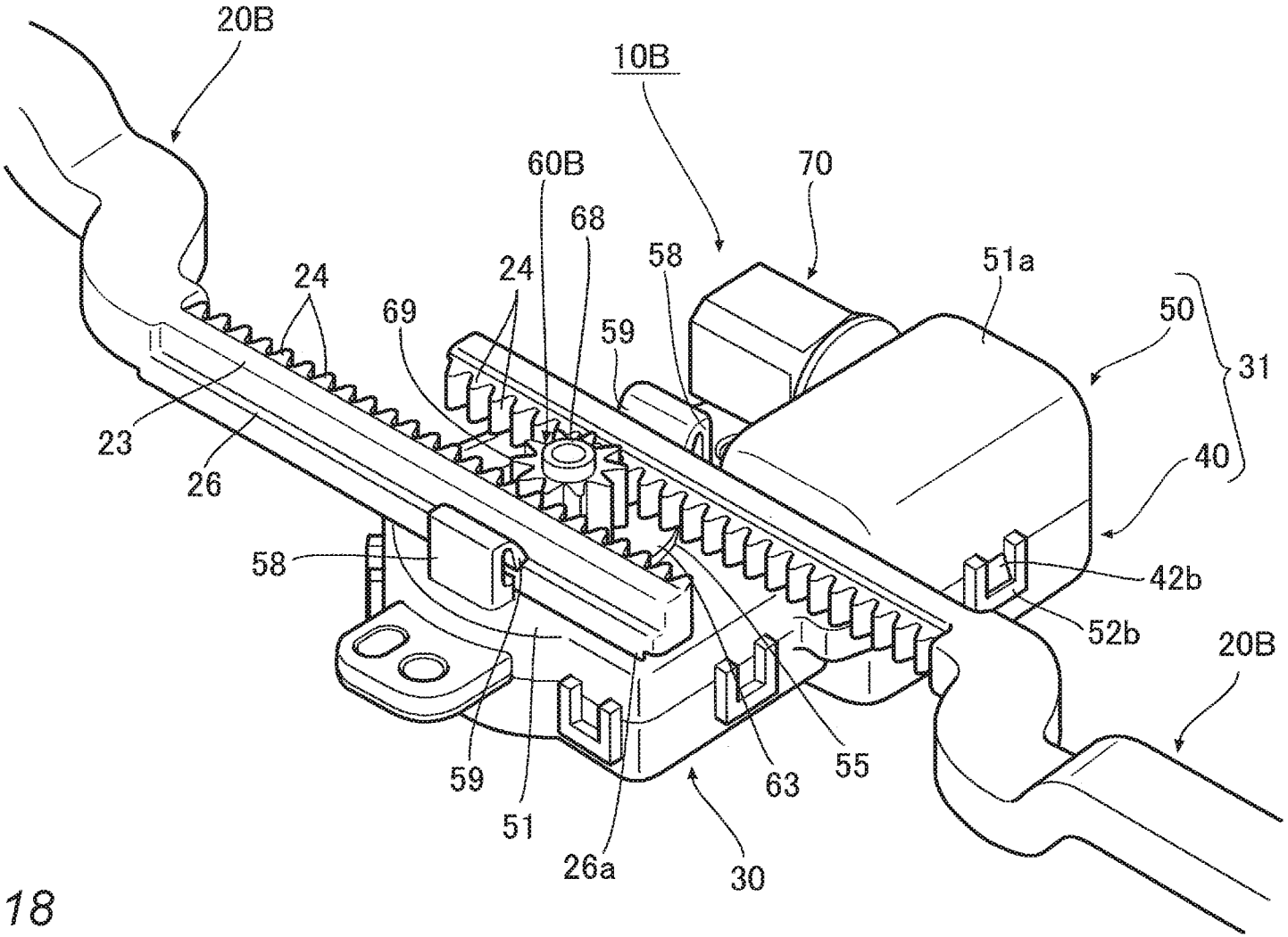
FIG. 18 is an enlarged perspective view of an essential part of a further embodiment of an electric locking device for an openable/closable member according to the invention.
Figure 19:
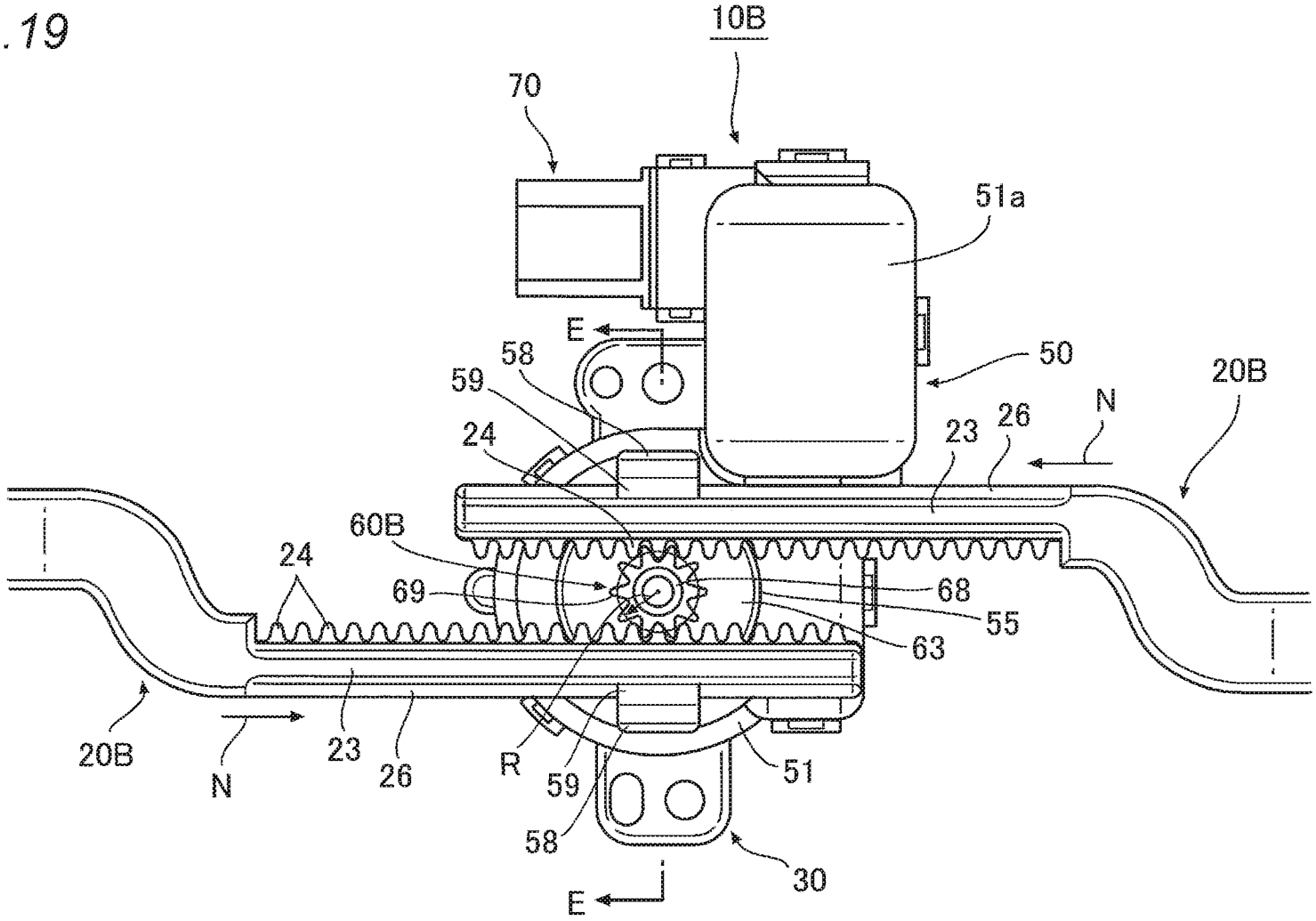
FIG. 19 is an enlarged plan view of the essential part of the electric locking device.
Figure 20:
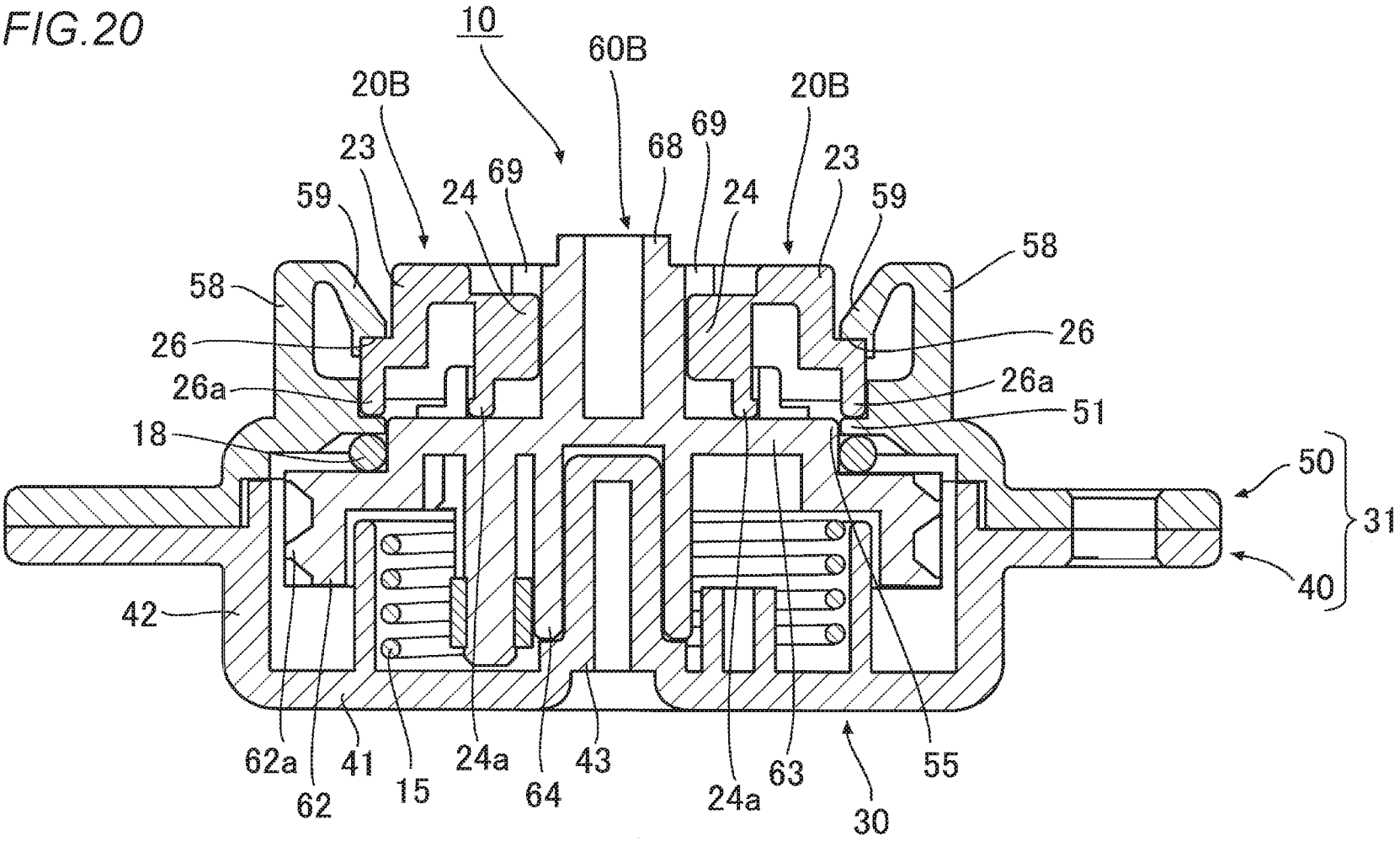
FIG. 20 is a sectional view taken along a line indicated by arrows E in FIG. 19.

FIGS. 18 to 20 show a further embodiment of an electric locking device for an openable/closable member according to the invention. It should be noted that like reference numerals will be given to portions which are substantially like to those of the embodiment described above, and the description thereof will be omitted here.

As shown in FIGS. 18 and 19, an electric locking device 10B for an openable/closable member (hereinafter, referred to as an "electric locking device 10B") of this embodiment differs from the embodiments described above in structure in proximal end portions 23, 23 of a pair of rods 20B, 20B are assembled to a rotating portion 63 of a worm wheel 60B.

As shown in FIG. 18, a cylindrical shaft portion 68 is provided at a center on a front surface side of the rotating portion 63 of the worm wheel 60 which projects outwards of the case so as to project therefrom, and a pinion gear 69 is formed on an outer circumference of the shaft portion 68 concentrically with the rotating portion 63.

On the other hand, racks 24 configured to mesh with the pinion gear 69 are formed individually on side surfaces of the proximal end portions 23, 23 of the pair of rods 20B, 20B at sides of the pinion gear 69 so as to extend along a direction in which the rods 20B extend. Additionally, an elongated projecting portion 26, which is a horizontally elongated projection, is formed along the extending direction of the rod 20B on a side surface, which is opposite to the side surface where the rack 24 is formed, of the proximal end portion 23 of each rod 20B.

As shown in FIG. 20, an elongated projecting abutment rib 24*a* is provided on a rear surface side of the rack 24 of each rod 20B so as to project therefrom, and as shown in FIGS. 18 and 20, an elongated projecting abutment rib 26*a* is provided also on a rear surface side of the elongated projecting portion 26 of each rod 20B so as to project therefrom. As shown in FIG. 20, the abutment ribs 24*a* on the rear surface sides of the racks 24 are brought into abutment with a front surface of the rotating portion 63, while the abutment ribs 26*a* on the rear surface sides of the elongated projecting portions 26 are brought into front circumferential edge of an opening portion 55 formed in a ceiling wall 51 of a second case 50, so that contact areas of the rods 20B with the worm wheel 60B and the second case 50 are reduced, whereby the sliding performance of the rods 20B is improved.

As shown in FIGS. 18 and 20, holding wall portions 58, 58 are provided at locations on a front surface side of the ceiling wall 51 of the second case 50 which face a rotational center of the worm wheel 60 so as to be erected therefrom, the holding wall portions 58, 58 being configured to hold the proximal end portions 23 of the rods 20B between the pinion gear 69 and themselves. A dislocation preventive claw 59 is provided to extend obliquely downwards from an upper end of each holding wall portion 58, and this dislocation preventive claw 59 locks on the elongated projecting portion 26 of the rod 20B not only to prevent the dislocation of the rod 20B but also to bias the rod 20B towards the pinion gear 69 of the worm wheel 60B (refer to FIGS. 18 and 20).

In this embodiment, the proximal end portion 23 of each rod 20B is disposed in a predetermined meshing position between the pinion gear 69 provided on the worm wheel 60B and the holding wall portion 58 provided on the case 31 so that the rack 24 of each rod 20B is oriented in a meshing direction with the pinion gear 69 of the worm wheel 60B, and each rod 20B is pushed in. By doing so, the rack 24 is allowed to mesh with the pinion gear 69, and the dislocation preventive claw 59 locks on the elongated projecting portion 26 of the rod 20B. Thus, the proximal end portion 23 of each rod 20B can be assembled to the rotating portion 63 of the worm wheel 60B so as to be interlocked therewith with the rod 20B biased towards the pinion gear 69 so as to be prevented from being dislocated therefrom.

In this embodiment, the pinion gear 69 is formed concentrically on the rotating portion 63 which project outwards of the case from the opening portion 55 of the case 31. Thus, the racks 24 at the proximal end portions of the rods are easily caused to mesh with the pinion gear 69, thereby making it possible to improve the workability in assembling the rods 20B to the rotating portion 63 of the worm wheel 60B.

Incidentally, as shown in FIG. 19, assuming that the driving force of the rods 20B is N, the rotational torque of the worm wheel 60B is T, and the driving radius of the rods 20B (a rotational locus of the worm wheel resulting when the rods slide) is R, the relationship among them is specified by the following expression (1).

$$N=T/R \quad (1)$$

As this occurs, in the case of the structure shown in FIGS. 1 to 17 in which the proximal end portions 23 of the rods 20, 21 are pivotally supported on the rotating portion 63 of the worm wheel 60, in order to prevent the pair of rods 20, 21 from interfering with each other, as shown in FIG. 10, a relatively great driving radius R need to be taken for the rods 20, 21. However, in the case of the rack and pinion structure shown in FIGS. 18 to 20, since the racks 24 and the pinion gear 69 are caused to mesh with each other inside the pair of rods 20B, 20B, the driving radius R of the rods 20B can be reduced (refer to FIG. 19).

Consequently, as shown by the above expression (1), in case the driving force N of the rods is made constant, when compared with the structure of pivotally supporting the rods shown in FIGS. 1 to 17, the rotational torque T of the worm wheel 60B in the case of the rack and pinion structure shown in FIGS. 18 to 20 can be made small. As a result of this, the output of the motor 33 can be reduced, and hence, the size of the motor 33 can be reduced, thereby making it possible to realize a reduction in cost.

It should be noted that the invention is not limited to the embodiments, and hence, various modifications can be made thereto without departing from the spirit and scope of the invention, and the resulting embodiments are included in the spirit and scope of the invention.

BRIEF DESCRIPTION OF REFERENCE NUMERALS

1 Fixed Member
2 Opening Portion
3 Locking Portion
5 Openable/Closable Member
10, 10A, 10B Electric Locking Device for Openable/Closable Member (Electric Locking Device)
15 Torsion Spring (Biasing Means)
18 Seal Ring
20, 20A, 20B, 21, 21A Rod
24 Rack
27 Lever
30 Actuator
31 Case
33 Motor
33*a* Rotational Shaft
35 Worm
35*a* Teeth
37 Power Supply Connector
38 Bus Bar
40 First Case
50 Second Case
55 Opening Portion
60, 60B Worm Wheel
62*a* Teeth
63 Rotating Portion
65 Rod Pivotally Supporting Portion
69 Pinion Gear
70 Connector Case

The invention claimed is:

1. An electric locking device for an openable/closable member attached to an opening portion in a fixed member so as to be opened and closed, comprising:

a pair of locking portions provided on one of the openable/closable member and the opening portion in the fixed member, a pair of rods disposed on the other of the openable/closable member and the opening portion in the fixed member and configured to engage with and disengage from the locking portions;

a biasing member configured to bias the pair of rods in a direction in which the pair of rods are brought into engagement with the locking portions; and an actuator for sliding the pair of rods to disengage from the pair of locking portions, wherein the actuator has a case having an opening portion, a motor disposed within the case, a worm rotated by the motor and, a worm wheel supported rotatably on the case and interlocked with the worm for rotation, wherein the opening portion of the case has a circular shape, wherein the worm wheel has a base portion, wherein an outer circumference of the base portion is formed with teeth configured to mesh with teeth of the worm, and wherein the worm wheel has a rotating portion erected from the base portion in a direction of a rotational axis of the worm wheel and inserted into an inner circumference of the opening portion of the case to be exposed to an outside of the case, and proximal end portions of the pair of rods are assembled individually to the rotating portion so as to move in an associated fashion, causing the pair of rods to slide in a synchronized fashion in opposite directions to each other.

2. The electric locking device for an openable/closable member according to claim 1, wherein the proximal end portions of the pair of rods are supported individually and pivotally on the rotating portion of the worm wheel.

3. The electric locking device for an openable/closable member according to claim 1, wherein a pinion gear is formed concentrically on the rotating portion of the worm wheel, a rack configured to mesh with the pinion gear is formed on the proximal end portions of the pair of rods, and the proximal end portions of the pair of rods are assembled individually to the rotating portion of the worm wheel so as to move in an associated fashion.

4. The electric locking device for an openable/closable member according to claim 1, wherein a seal ring is interposed between a rear circumferential edge of the opening portion in the case and a portion of the worm wheel which faces the rear circumferential edge of the opening portion.

5. The electric locking device for an openable/closable member according to claim 4, wherein when the pair of rods are caused to slide in a disengaging direction from the pair of locking portions by rotating the worm wheel via the worm, the worm wheel is pressed against the seal ring due to a pressing force imparted to teeth of the worm wheel from the worm.

6. The electric locking device for an openable/closable member according to claim 1, having a holder configured to hold the rods in such a state that the rods are not brought into engagement with the locking portions against a biasing force of the biasing member when the pair of rods are caused to slide in a disengaging direction from the pair of locking portions as a result of rotation of the worm wheel and releasing the holding of the rods to cause the rods to slide in an engaging direction with the locking portions when the openable/closable member is closed relative to the opening portion in the fixed member.

7. The electric locking device for an openable/closable member according to claim 1, further comprising a connector case for insertion of a power supply connector, wherein the motor is connected to a bus bar which is incorporated in the connector case to electrically communicate with the power supply connector inserted into the connector case, and wherein the connector case is disposed on the same side as the worm wheel with respect to an axis of the worm and in parallel to an axial direction of the worm.

8. The electric locking device for an openable/closable member according to claim 7, wherein a connector case of the actuator is a separate member from the case and is attached detachably to the case.

9. The electric locking device for an openable/closable member according to claim 1, further comprising a pair of rod pivotally supporting portions that protrude from the rotating portion.

10. The electric locking device for an openable/closable member according to claim 9, wherein a first of the proximal end portions of a first of the pair of rods connects to a first of the pair of rod pivotally supporting portions, and wherein a second of the proximal end portions of a second of the pair of rods connects to a second of the pair of rod pivotally supporting portions.

11. The electric locking device for an openable/closable member according to claim 9, wherein each of the pair of rod pivotally supporting portions individually connects to each of the proximal end portions of the pair of rods.

12. The electric locking device for an openable/closable member according to claim 9, wherein each of the proximal end portions of the pair of rods include an opening that is pushed over each of the pair of rod pivotally supporting portions to operably connect the proximal end portions of the pair of rods to the rod pivotally supporting portions.

* * * * *